US005169652A

United States Patent [19]

Del Monte

[11] Patent Number: 5,169,652

[45] Date of Patent: Dec. 8, 1992

[54] MOLDING MACHINE

[76] Inventor: Ernest J. Del Monte, 46 Harwood La., E. Rochester, N.Y. 14445

[21] Appl. No.: 747,861

[22] Filed: Aug. 20, 1991

[51] Int. Cl.[5] ..... B28B 1/14; B28B 1/20

[52] U.S. Cl. ..... 425/439; 425/435; 425/441; 425/450.1

[58] Field of Search ..... 425/435, 438, 439, 62, 425/63, 425, 441, 450.1

[56] References Cited

U.S. PATENT DOCUMENTS

| | | | |
|---|---|---|---|
| 1,881,322 | 10/1932 | McMullin | 425/435 |
| 3,274,306 | 9/1966 | Kesting | 425/441 |
| 3,568,272 | 3/1971 | Zmania | 425/435 |
| 3,781,157 | 12/1973 | Maringer et al. | 425/435 |
| 3,799,729 | 3/1974 | Hagen | 425/435 |
| 3,853,452 | 12/1974 | Del Monte | 425/450.1 |
| 4,247,279 | 1/1981 | Masters | 425/435 |
| 4,890,999 | 1/1990 | Del Monte | 249/63 |
| 4,956,135 | 9/1990 | Payne | 425/435 |

*Primary Examiner*—Willard E. Hoag
*Attorney, Agent, or Firm*—Samuel R. Genca

[57] ABSTRACT

A molding machine for casting a product is disclosed in a preferred embodiment of the invention. The molding machine includes a stationary support system and a rotatable apparatus, an opening and a horizontal axis of rotation parallel to the opening. Rotational means rotate the rotatable apparatus 180 degrees from a load and unload position to a casting position. A hoisting means is fixed to the reverse side of the opening of the rotatable apparatus for raising or lowering a transporter coupled to the opening of said rotatable apparatus. The mold includes a configuration form, having a ring-shaped floor, which cooperates with exterior wall forming panels. The mold also includes an inner core assembly which cooperates with the configuration form and has corner forming panels, interior wall forming panels and a floor forming panel. The corner forming panels move against the configuration form and the floor forming panel angularly to the configuration form and the floor forming panel. The interior wall forming panels lock in the corner forming panels and move angularly to the configuration form and the floor forming panel, when the rotatable apparatus is in the load and unload position.

20 Claims, 25 Drawing Sheets

10

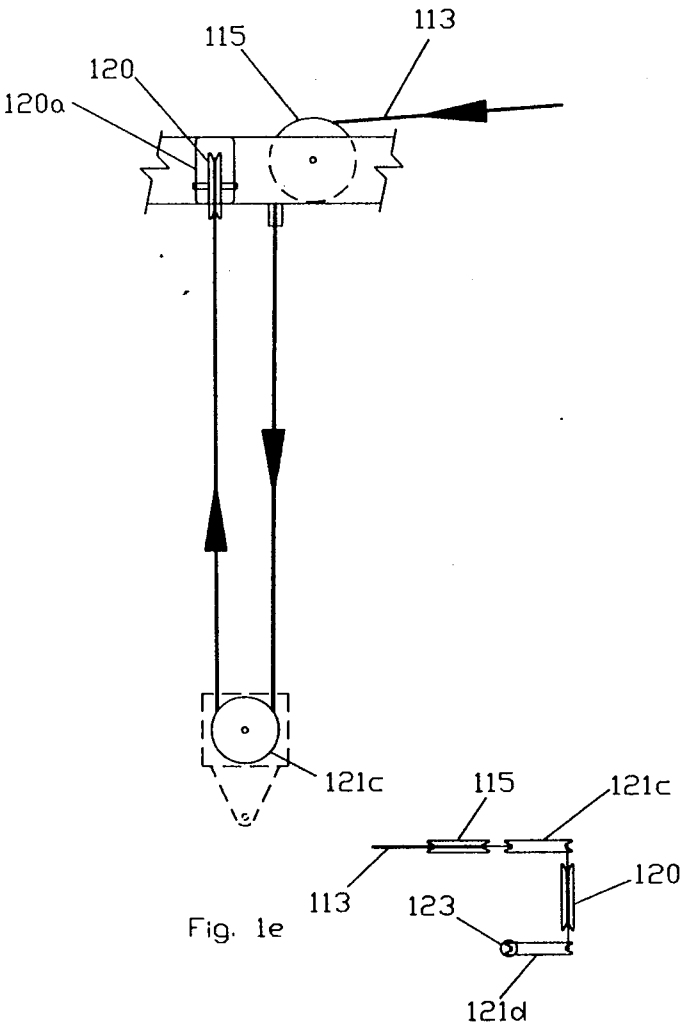
Fig. 1e
Fig. 1f
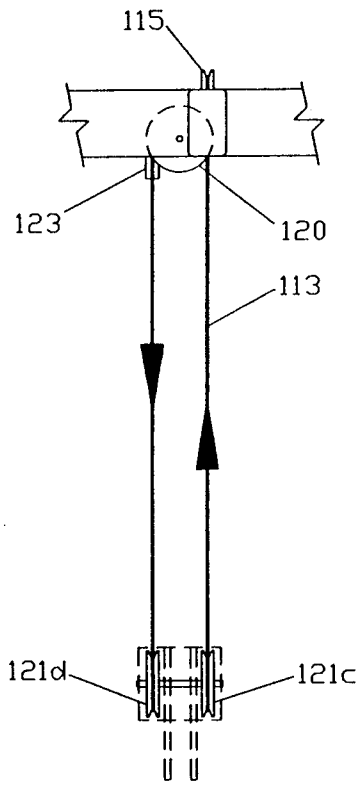
Fig. 1d
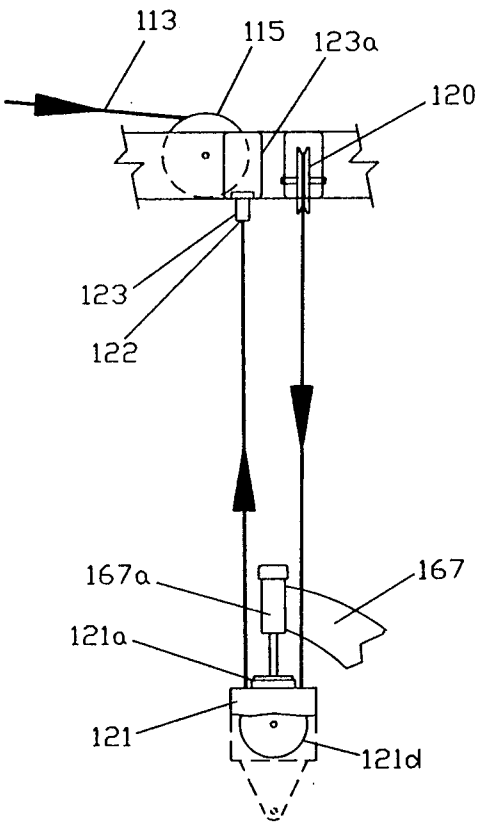
Fig. 1c

MOLDING MACHINE

BACKGROUND OF THE INVENTION

The present invention relates to a molding machine for casting a product from a material such as concrete or the like and having draft-free walls, square corners, vertical sides and a horizontal bottom, cast into a monolithic product.

PRIOR ART

In my prior patent, U.S. Pat. No. 3,853,452, there is disclosed a molding machine and method of industrial mass produced modular units with repetitive use and accuracy. The molding machine includes interior, exterior and corner wall forming panels which are moveable in a parallel direction, on a portable superstructure. The portable superstructure can be lifted and placed on a molded concrete floor where the interior, exterior and corner wall forming panels act as a form for pouring concrete therein, to cast the walls to the floor.

In my prior patent, U.S. Pat. No. 4,890,999, there is disclosed a molding machine which utilizes a rotatable apparatus that includes a hoisting system that is fixed to the same for raising or lowering a transporter to the rotatable apparatus. The hoisting system and transporter are rotated by the rotatable apparatus between a casting position and a discharge position. The molding machine includes a storage means for the transporter while concrete is being poured between exterior, interior and corner forming panels which are moveable and parallel with respect to each other and on the floor forming panel.

Other attempts in the prior art for molding hollow articles, made of material such as concrete, employed complicated forms which were assembled for pouring of concrete, or such other materials, between retaining walls. While such prior art methods and apparatus were adequate for their intended purpose, they did not lend themselves for use in industrially, mass-produced modular units or modules, since it was difficult to reassemble the forms after each pouring of concrete, or such other material, and to repeat the same performance in a relatively short period of time.

Accordingly, there still exists a pressing need for a truly industrial means and methods for mass-producing products, such as modular units, for motels, hotels, apartments, hospitals, correctional institutions, stores, offices and houses, which means and methods are efficient, accurate and easy to operate so as to produce sound structural and architecturally artistic products, such as modular units or modules, for the above use.

SUMMARY OF THE INVENTION

Briefly described, a molding machine for producing a monolithic product having draft free walls, square corners, and a floor/ceiling in accordance with a preferred embodiment of the invention is disclosed. The molding machine comprises a stationary support system and a rotatable apparatus mounted for rotation along a horizontal axis of rotation. There is an opening on a side of the rotatable apparatus parallel to the horizontal axis of rotation. A rotational means is fixed to the support system and connected to the rotatable apparatus for rotating the rotatable apparatus, and the opening therein, 180 degrees between a load and unload position and a casting position. A locking means, cooperating with the stationary support system and the rotatable apparatus, is used for selectively locking the rotatable apparatus in the casting position or the load/unload position hereinafter referred to as the load/unload position. a transporter is a portable side of the rotatable apparatus and covers the opening on the side of the rotatable apparatus. A hoisting means is fixed to an exterior surface of an other side of the rotatable apparatus. The hoisting means is diametrically opposite, and coupled, to the transporter. A jacking mechanism means is used for lifting and for moving the transporter from the opening in the side of the rotatable apparatus, when the rotatable apparatus is in the casting position. The rotatable apparatus includes a mold which has a configuration form that is fixed to the interior surface of the other side of the rotatable apparatus and is diametrically opposite to the opening in the side of the rotatable apparatus. The configuration form has a ring-shaped casting floor of a given width between outside walls and inside walls of the configuration form. The mold includes exterior wall forming panels which cooperate with the outside walls of the configuration form for defining exterior walls of the product. First means for moving the exterior wall forming panels toward the outside walls of the configuration form to cast the product and for moving the exterior wall forming panels away from the outside wall of the configuration form, to release the product onto the transporter, connected to the hoisting means, when the rotatable apparatus is in the load/unload position. The mold includes an inner core means for casting the interior walls and the floor of the product. The inner core means includes an inner core frame disposed within the configuration form and fixed to the interior surface of the other side of the rotatable apparatus. A floor forming panel is fixed to the inner core frame and spaced from the ring-shaped casting floor of the configuration form. The mold includes corner forming panels which are in cooperative relationship with the configuration form and the floor forming panel for casting the product. Second means connected to the corner forming panels for moving the corner forming panels at an angle with respect to the floor forming panel and the inside walls of the configuration form and parallel to the inside walls of the configuration form, when the rotatable apparatus is in the load/unload position. Interior wall forming panels in cooperative relationship with the inside walls of the configuration form, the floor forming panel and the corner forming panels, for casting the product when the rotatable apparatus is in the casting position. Third means for moving the interior wall forming panels at an angle with respect to the floor forming panel and the inside walls of the configuration form and parallel to the inside wall of the configuration form, when the rotatable apparatus is in the load/unload position. The hoisting mean supports the product and the transporter, and is useful for raising and lowering the product and the transporter. Other advantages of the invention will be disclosed herein.

BRIEF DESCRIPTION OF THE DRAWINGS

The invention, and all its species, both as to its organization and method of operation, will best be understood by reference to the following description taken in connection with the accompanying drawing, in which:

FIG. 1*c* is a partial, cross-sectional view of one part of the hoisting system which co-operates with a retention device;

FIG. 1*d* is a side view of FIG. 1*c*;

FIG. 1*e* is a back view of one part of the hoisting system as shown in FIG. 1*c*;

FIG. 1*f* is a fragmentary, plan view of one part of the hoisting system shown in FIG. 1*c*;

DETAILED DESCRIPTION OF THE PREFERRED EMBODIMENT

Figure 1:
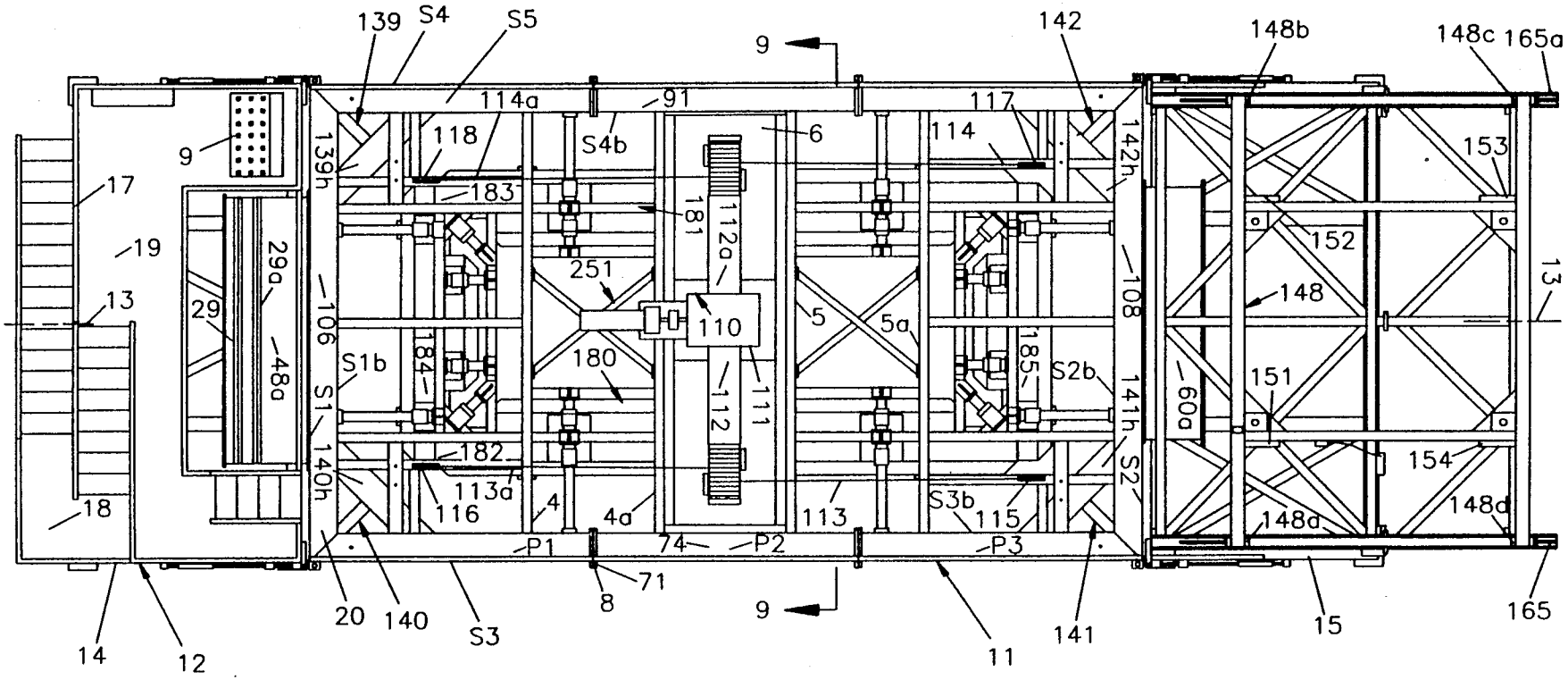
FIG. 1 is a plan top view of the molding machine showing a rotatable apparatus in the load/unload position with a mold in the casting mode and a truck in the parked position and a hoisting system in accordance with the preferred embodiment of the invention.
Figure 1A:
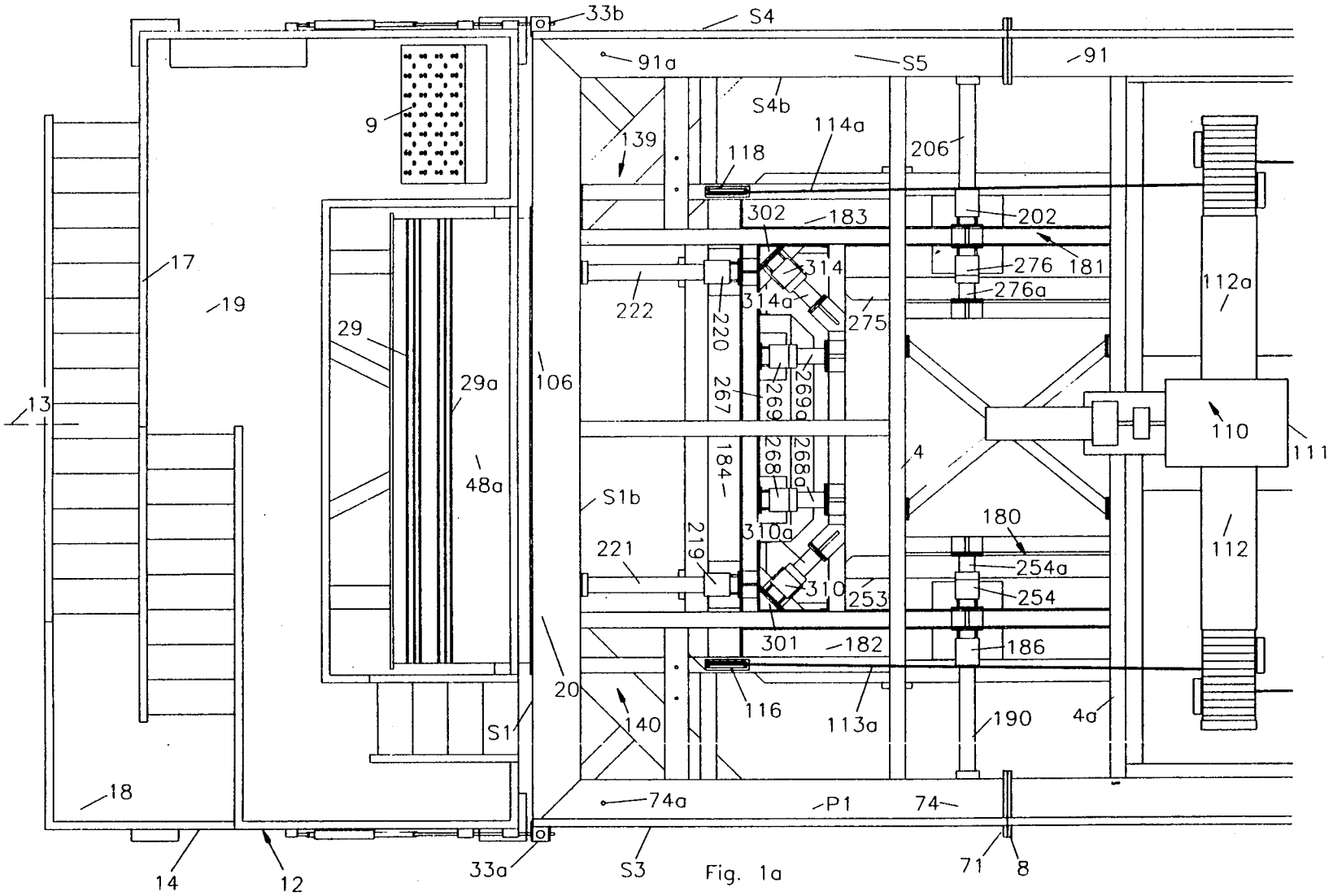
FIG. 1*a* and FIG. 1*b* are an enlarged view of FIG. 1.
Figure 1B:
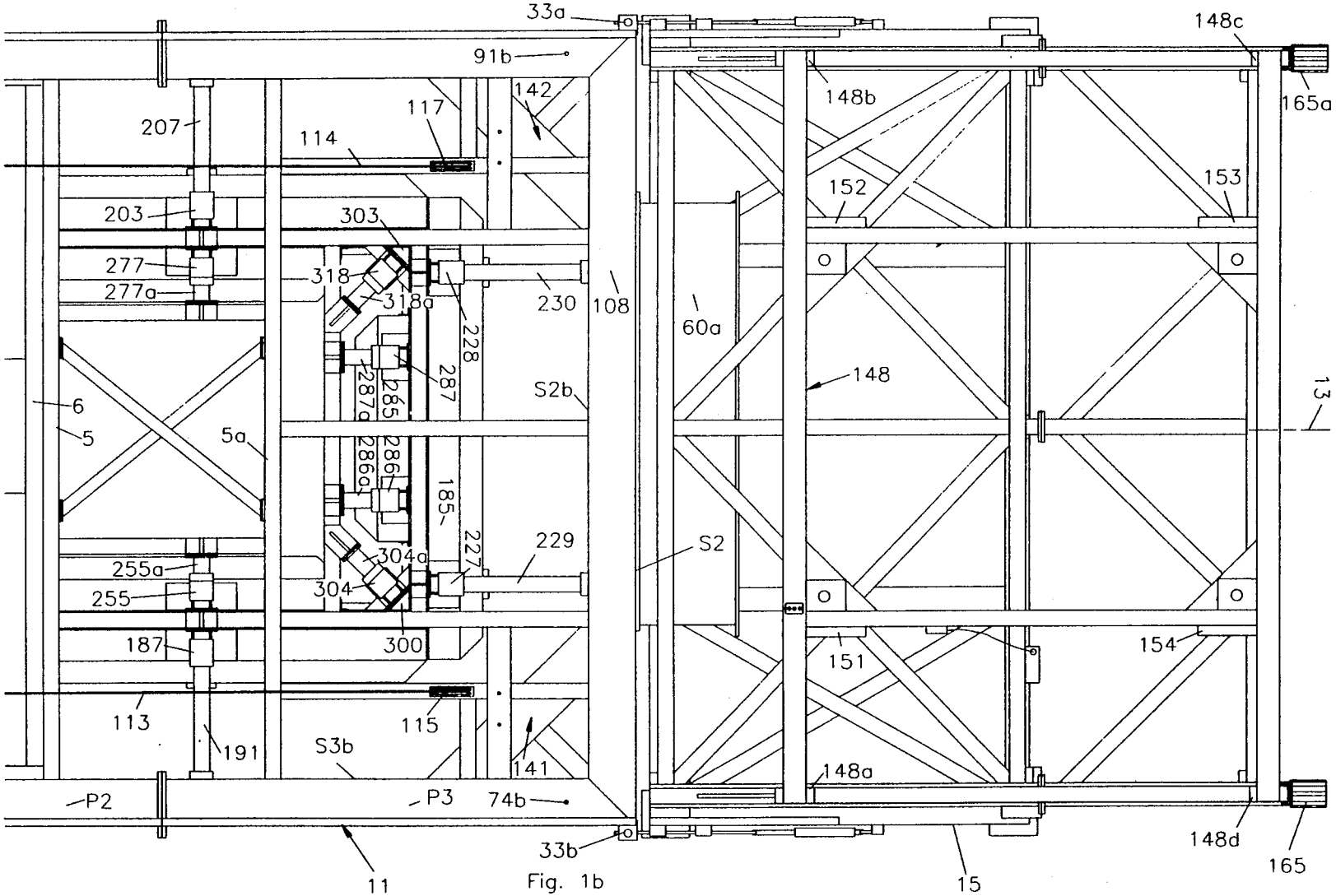

Referring first to FIGS. 1–11 of the drawing, and in accordance with the invention, there is shown a preferred embodiment of the invention in a molding machine 10. The molding machine 10 has many aspects in keeping with established engineering standards and practices and, therefore, shall not be elaborated herein; only what is new and unique about this invention shall be set forth herein. The molding machine 10 includes a rotatable apparatus 11 having a horizontal axis of rotation 13 for rotating 180 degrees the rotatable apparatus 11 between a casting position and a load/unload position and a stationary support system 12. The stationary support system 12 includes a first frame or an end with stairway 14 and a second frame or an end without stairway 15, opposite to, and spaced from, the end with stairway 14. The horizontal axis of rotation 13 also spans from the end with stairway 14 across to the end without stairway 15. The horizontal axis of rotation 13 is at a height H1 above ground level or a floor 16. The end with the stairway 14 includes a staircase 17 which may be used to climb to different levels 18, 19 and 20, respectively. A control console 9, located at the level 19, sends out electrical signals to effect clockwise and counter-clockwise signals, forward/reverse signals and start/stop signals, in a manner to be explained hereinafter.

The end with the stairway 14 includes a rotational means or rotational drive assembly 24 having an electric motor 21, a gear reduction system 22 and a motor pulley 23. The rotational drive assembly 24 is yieldingly connected to end with stairway 14 by springs 26, 26*a*, 27, 27*a*, 28, 28*a*, 30 and another spring which is not shown. All of the foregoing springs provide the necessary tension on motor cables 29 and 29*a* to take up any slack on the motor cables 29 and 29*a* in a manner well known to those skilled in the art. The cable 29*a* is a secondary safety cable and, therefore, comes into play if motor cable 29 should break.

The rotatable apparatus 11 is of hexahedronal shape, having six sides: a first side S1, a second side S2, a third side S3, a fourth side S4, a fifth side S5 and a sixth side S6. The sixth side S6 includes a work deck 133 and an opening 133*a*. The rotational means or the rotational drive assembly 24 is fixed to the stationary support system 12 and is connected to the rotatable apparatus 11 for rotating said rotatable apparatus 11 and being moved thereby so that the opening 133*a* in the sixth side S6 of the rotatable apparatus 11 faces downward in a load/unload position. The rotational means or the rotational drive assembly 24 rotates the rotatable apparatus 11 upwards 180 degrees so that the opening 133*a* in the sixth side S6 of the rotatable apparatus faces upwards in a casting position. Locking means 33*a* and 33*b* on side S3 and locking means 33*a* and 33*b* on side S4 selectively lock sides S3 and S4, respectively, of the rotatable apparatus 11 in the load/unload position and the casting position, with respect to the first frame 14 and second frame 15 of the stationary support system 12.

The first side S1 includes tubular bars 75 and 94 which are mutually perpendicular to tubular bars 106 and 107 and are strengthened by cross-bars 41 and 41*a*. The first side S1 also includes on its exterior surface S1*a* a trunnion plate 42 fixed to tubular bars 106 and 107 and a motorized trunnion 43 fixed to the trunnion plate 42 at the center 51 of the tubular bars 75, 94, 106 and 107. The motorized trunnion 43 on the exterior surface S1*a* of the first side S1 includes a motorized gudgeon 48 which rides on sockets 49 and 49*a*. The sockets 49 and 49*a* locate the center 51 of the motorized trunnion 43 to coincide with the horizontal axis of rotation 13 of the molding machine 10. The sockets 49 and 49*a* support the motorized gudgeon 48 along its exterior surface 48*a*.

The sockets 49 and 49*a* are angularly set on pillow blocks 54 and 54*a*, respectively, which are fixed to a stationary tubular bar 55 of the end with stairway 14 of the stationary support system 12. The motorized trunnion 43, trunnion plate 42 and tubular bars 75, 94, 106 and 107 may be moved in a clockwise or counter-clockwise direction in response to the motor cables 29 and 29*a*. The motor cables 29 and 29*a* connect the motorized gudgeon 48 to the motor pulley 23 which is connected to a gear reduction system 22 and electric motor 21 which are all part of the rotational drive assembly 24. The motorized trunnion 43 may be moved in a clockwise or counter-clockwise direction in response to electrical power signals being transmitted from the control console 9 to the electric motor 21 by a wire (not shown).

Diametrically opposite to first side S1 is second side S2 which includes tubular bars 73 and 92 which are mutually perpendicular to tubular bars 108 and 109 and include cross-members 45 and 45*a* connected to tubular bars 73, 108, 109 and 92. Second side S2 includes a trunnion plate 46 which is fixed to the cross-members 45 and 45*a* and to tubular bars 108 and 109. Fixed to the center 62 of the trunnion plate 46 is a trunnion 47 which includes a gudgeon 60. The gudgeon 60 is supported by sockets 61 and 61*a* along the exterior surface 60*a* of the gudgeon 60. The sockets 61 and 61*a* are angularly set on pillow blocks 65 and 65*a*, respectively. The pillow blocks 65 and 65*a* are fixed to the stationary tubular bar 66 of the end without stairway 15 of the stationary support system 12. It may now be seen that the horizontal axis of rotation 13 of the molding machine 10 is truly the same for the first side S1 and second side S2 because the centers 51 and 62, respectively, are along the horizontal axis of rotation 13.

Figure 2:
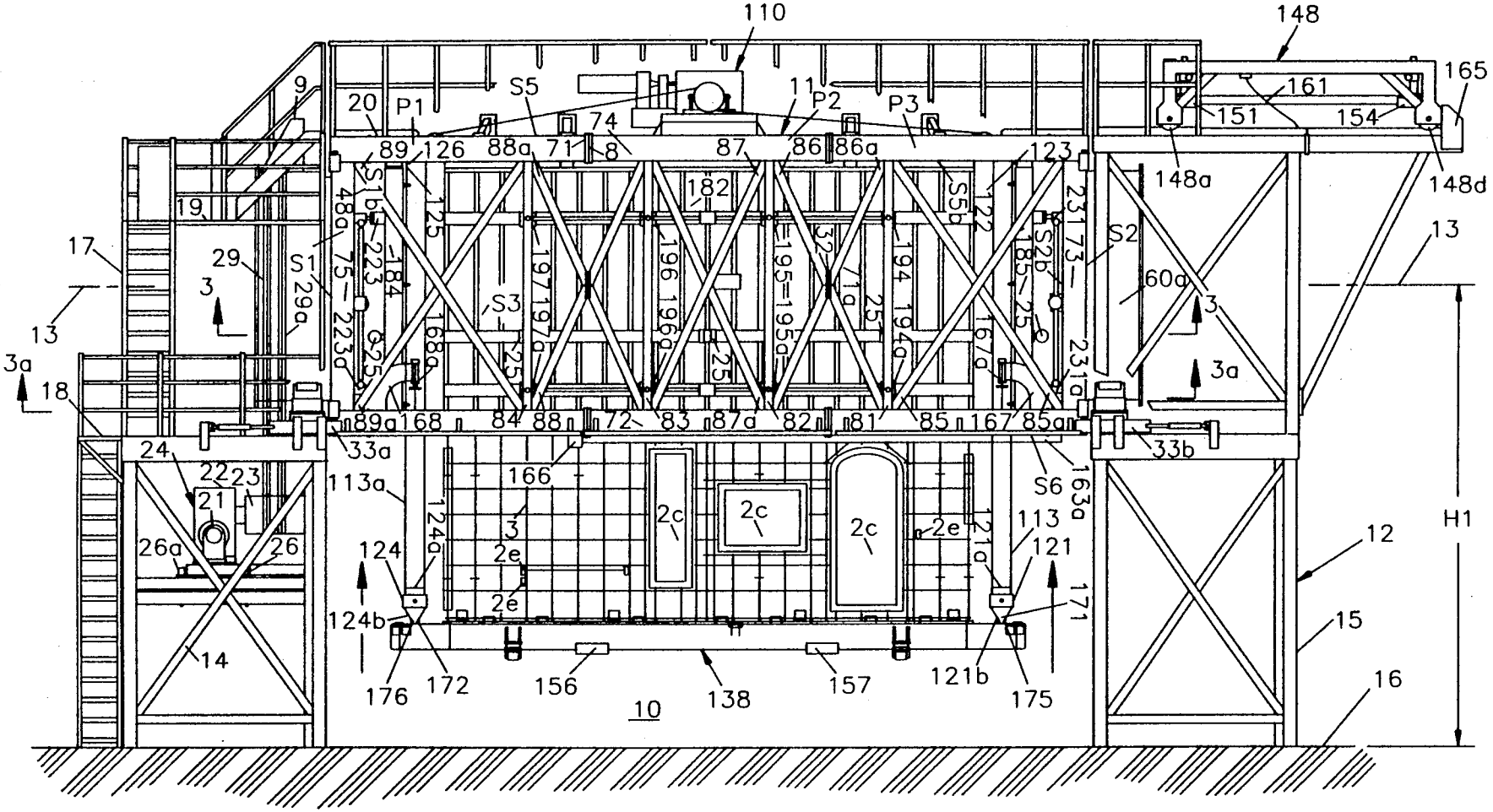
FIG. 2 is a front view of the molding machine, with the rotatable apparatus and the mold in a load/unload position, and showing the hoisting system loading a re-inforcing cage and a transporter into the mold and rotatable apparatus.

The third side S3 of the rotatable apparatus 11 as shown in FIG. 2 of the drawing, includes the tubular bar 73 of second side S2 and the tubular bar 75 of first side S1 and tubular bars 72 and 74 are mutually perpendicular to tubular bars 73 and 75, respectively, and thereby provide the proper spacing between first side S1 and second side S2. The tubular bars 72, 73, 74 and 75 strengthen the third side S3. The third side S3 is further strengthened by tubular members 81, 82, 83 and 84, spaced at given intervals from each other, and fixed between tubular bars 72 and 74. Between tubular bar 73 and tubular member 81 are cross-members 85 and 85*a*; between tubular members 81 and 82 are cross-members 86 and 86*a*; between tubular members 82 and 83 are cross-members 87 and 87*a*; between tubular members 83 and 84 are cross-members 88 and 88*a*; and between tubular member 84 and tubular bar 75 are cross-members 89 and 89*a*; all of the foregoing give the third side S3 rigidity and strength.

Figure 5:
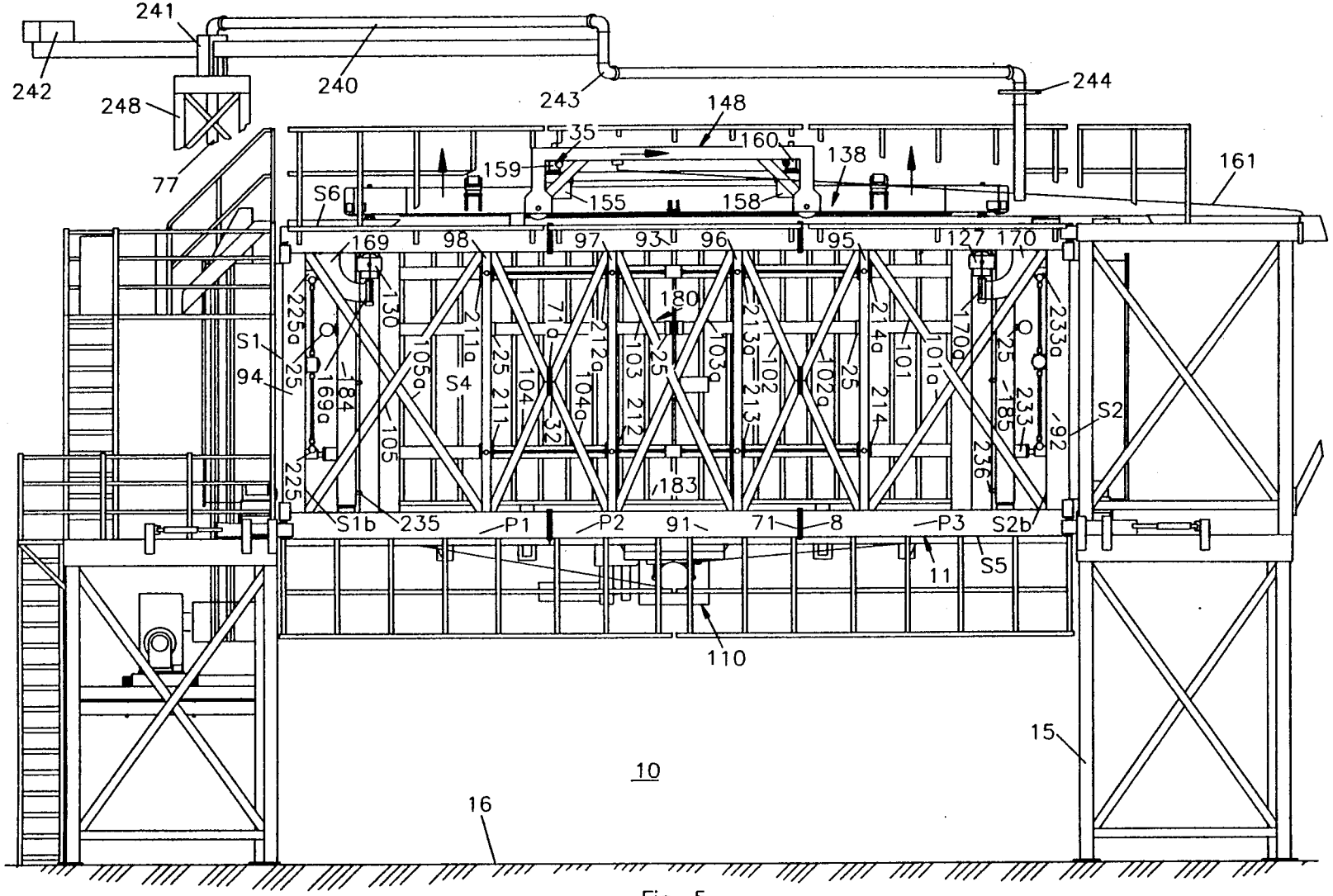
FIG. 5 is another front view of the molding machine shown in FIG. 2, except that the rotatable apparatus of the molding machine is in a casting position and a truck is lifting the transporter from the rotatable apparatus.

Fourth side S4 of the rotatable apparatus 11 as shown in FIG. 5 of the drawing, includes the tubular bar 92 of second side S2 and the tubular bar 94 of first side S1 and tubular bars 93 and 91 are mutually perpendicular to tubular bars 92 and 94, respectively, and thereby provide the proper spacing between first side S1 and second side S2. The tubular bars 93, 92, 91 and 94 strengthen the fourth side S4. Fourth side S4 is further strengthened by tubular members 95, 96, 97 and 98 spaced at given intervals from each other, and fixed between tubular bars 93 and 91. Between tubular bar 92 and tubular member 95 and are cross-members 101 and 101*a*; between tubular members 95 and 96 are cross-members 102 and 102*a*; between tubular members 96 and 97 are cross-members 103 and 103*a*; between tubular members 97 and 98 are cross-members 104 and 104*a*; between tubular member 98 and tubular bar 94 are cross-members 105 and 105*a*; all of the foregoing give the fourth side S4 rigidity and strength.

Referring to FIGS. 1, 2, 9 and 11 of the drawing there is shown a fifth side S5 of the rotatable apparatus 11. The fifth side S5 includes the tubular bar 106 of side S1, the tubular bar 74 of side S3, the tubular bar 108 of second side S2 and the tubular bar 91 of the fourth side S4. The tubular bar 106 of the first side S1 is welded to tubular bars 74 and 91, while tubular bar 108 of the second side S2 is welded to tubular bars 74 and 91. The fifth side S5 includes tubular beams 4, 4*a*, 5 and 5*a* which interconnect tubular bars 74 and 91. A hoisting support plate 6 that is interconnected between tubular beams 4*a* and 5 supports the hoisting means or the hoisting system 110. The hoisting system 110 includes a gear drive 111 for driving diametrically opposed pulleys 112 and 112*a* which turn in the same direction when in operation in response to clockwise and counterclockwise power signals from the control console 9. The pulley 112 includes cables 113 and 113*a*, which convolve about the pulley 112. The pulley 112*a* drives the cables 114 and 114*a* to convolve about the pulley 112*a*. The cable 113 is guided by a pulley 115 while cable 113*a* is guided by another pulley 116. The pulleys 115 and 116 change the direction of the cables 113 and 113*a*, respectively, from horizontal to vertical between the first side S1, second side S2, the third side S3 and the fourth side S4. The cable 114 is guided by pulley 117 from the horizontal position downward to the vertical position. The cable 114*a* is guided by pulley 118 in the same manner as that for cable 114. The cables 113, 113*a* and 114, 114*a*, operate within the rotatable apparatus 11 and do so in near-parallel relationship to the interior surfaces S1*b*, S2*b*, S3*b* and S4*b*, of sides S1, S2, S3 and S4, respectively.

Referring to FIGS. 1, 1*a*, 1*b*, 1*c*, 1*d*, 1*e*, 1*f* and 2 of the drawing, the cable 113 is drawn across pulley 115, which pulley 115 is fixed to the fifth side S5 of the rotatable apparatus 11, and is rotated as cable 113 is passed to another pulley 121*c* in a block 121. The cable 113 is then drawn across another pulley 120, which pulley 120 is fixed to the fifth side S5 of the rotatable apparatus 11, and is rotatated as cable 113 is passed to another pulley 121*d* in the block 121. The cable 113 is then anchored by anchor 123 by cable end 122 fixed on the fifth side S5 of the rotatable apparatus 11. As more of the cable 113 is paid out, the block 121 is lowered. As less of the cable is paid out, the block 121 is raised. Cables 113, 113*a*, 114, and 114*a*, all work in the same manner and all the blocks 121, 124, 127 and 130 retain the cables 113, 113*a*, 114 and 114*a*, when the retention devices 167, 168, 169 and 170 engage the blocks 121, 124, 127 and 130, respectively.

Figure 11:
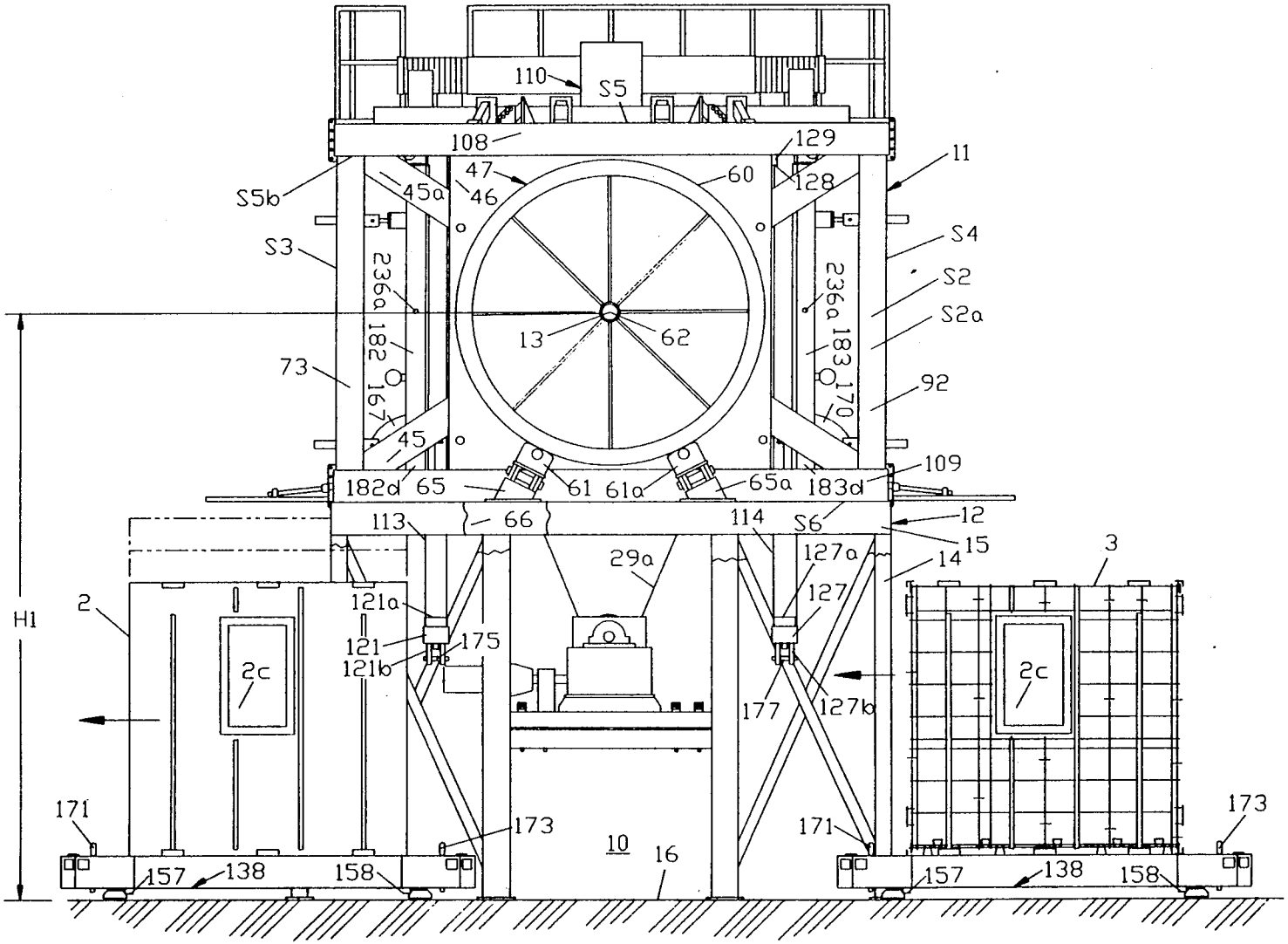
FIG. 11 is a right-hand partial view of the molding machine in the load/unload position and a casted product on a transporter is moved from the load/unload position while a reinforced cage on another transporter is readied to be moved into the load/unload position of the molding machine.

In a similiar manner cable 113*a* is fed through a block 124 and the cable end 125 is secured by an anchor 126 attached to an interior surface S5*b* of side S5. The block 124 includes a securing means 124*b* for securing the transporter 138 while it is being lifted or lowered by the hoisting system 110. Referring to FIG. 11 of the drawing, the cable 114 is fed through a block 127 and the cable end 128 is secured by an anchor 129 attached to the interior surface S5*b* of side S5. The block 127 includes a securing means 127*b* for securing the transporter 138 while it is being lifted or lowered by the hoisting system 110.

Figure 9:
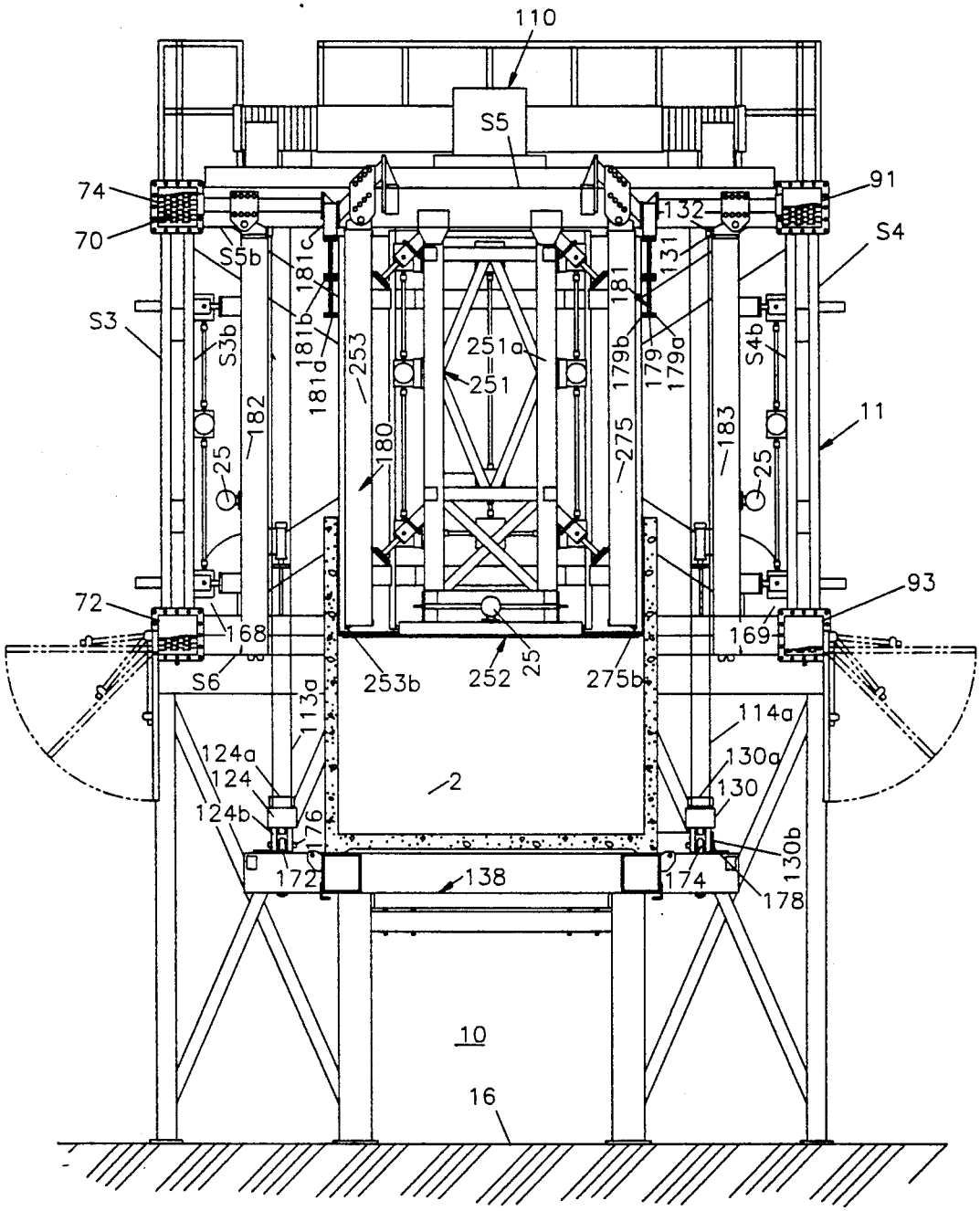
FIG. 9 is a partial, cross-sectional view of the molding machine taken along line 9—9 of FIG. 1, showing the rotatable apparatus has been rotated to the load/unload position and the mold, in the release mode, has released the product to the transporter, then the transporter and product are lowered away to the floor.

Referring to FIG. 9 of the drawing, the cable 114*a* is fed through a block 130 and is secured at cable end 131 by an anchor 132 attached to the interior surface S5*b* of side S5. The block 130 includes a securing or coupling means 130*b* for securing the transporter 138 while it is being lifted or lowered by the hoisting system 110.

Referring to FIGS. 2, 5, 9 and 11 of the drawing, the hoisting system 110 includes retention devices 167, 168, 169 and 170 for retention of the blocks 121, 124, 127 and 130, respectively, fixed to the rotatable apparatus 11. The retention devices 167, 168, 169 and 170 have spring loaded pistons 167*a*, 168*a*, 169*a* and 170*a*, respectively, that are in the path of the blocks 121, 124, 127 and 130, respectively, of the hoisting system 110. The blocks 121, 124, 127 and 130 each have a corresponding securing or coupling means 121*b*, 124*b*, 127*b* and 130*b*, for securing the transporter 138 while it is being lifted or lowered by the hoisting system 110.

The blocks 121, 124, 127 and 130 each have a flat surface designated 121*a*, 124*a*, 127*a* and 130*a*, respectively, for receiving therein the spring loaded pistons 167*a*, 168*a*, 169*a* and 170*a*. The retention devices 167, 168, 169 and 170 hold the blocks 121, 124, 127 and 130 of the hoisting system 110 and rotate with the rotatable apparatus 11 to the casting position while retaining the blocks 121, 124, 127 and 130 in such position so as to prevent the cables 113, 113*a* and 114, 114*a*, from falling to the ground or floor 16 by keeping tension on cables 113, 113*a*, 114 and 114*a*, when the transporter 138 is released. The blocks 121, 124, 127, and 130 each have a securing means 121*b*, 124*b*, 127*b* and 130*b*, respectively, which align with I-bolts 171, 172, 173 and 174, and in the same order, are fixed by means of pins 175, 176, 177 and 178 to the transporter 138. The hoisting means or hoisting system 110 couples the transporter 138 to the rotatable apparatus 11. The hoisting means or hoisting system 110 raises or lowers the transporter 138 to the opening 133*a* when the rotatable apparatus 11 is in the load/unload position. The transporter 138 also rotates with the rotatable apparatus 11 to the casting position or the load/unload position.

Figure 6:
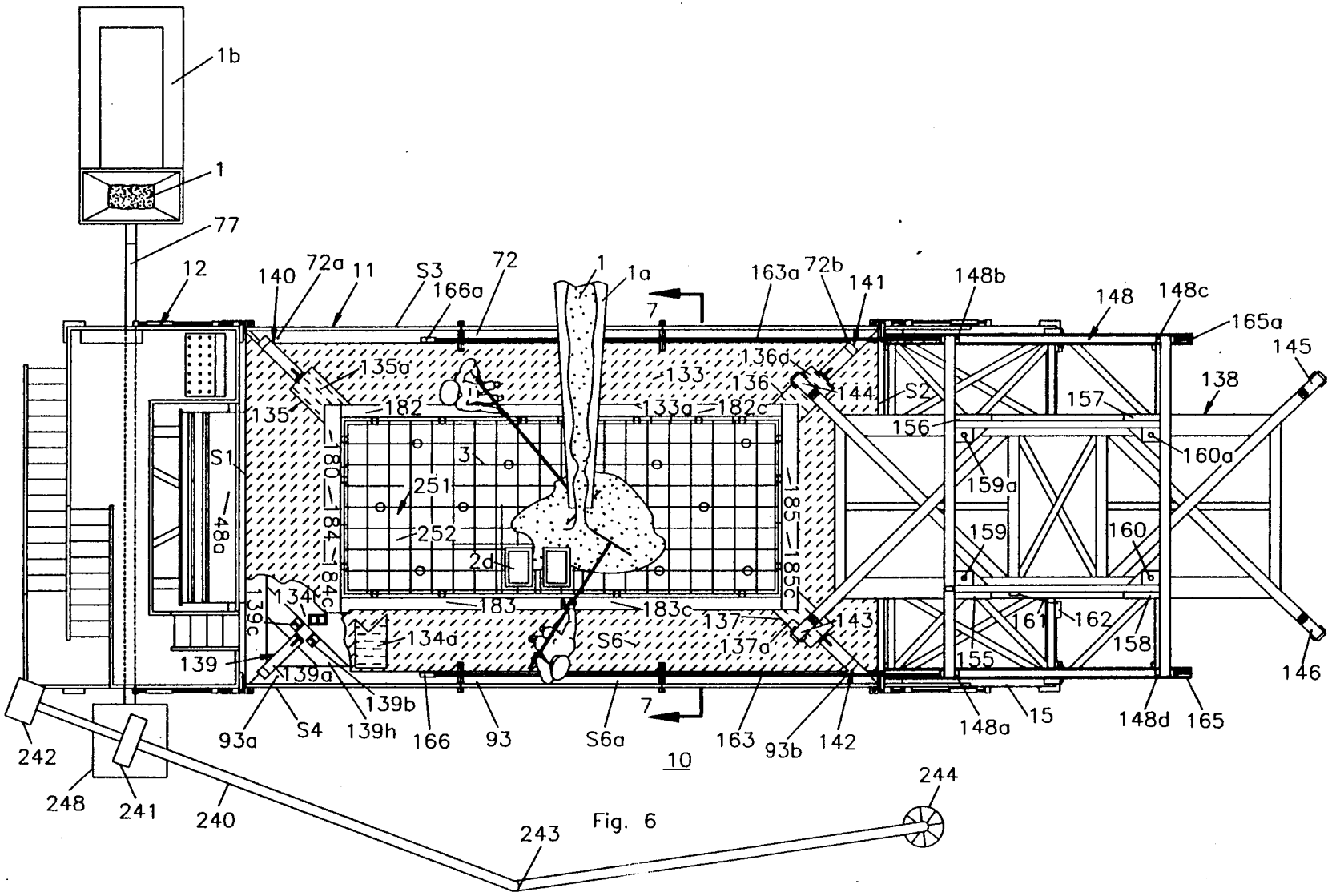
FIG. 6 is another plan top view of the molding machine where the rotatable apparatus has been rotated 180 degrees from the load/unload position to the casting position, and material, such as concrete, is being poured into the mold while the transporter has been moved to a parked position by the truck.

Referring to FIGS. 1 and 6 of the drawings, the rotatable apparatus 11 has been rotated 180 degrees from the load/unload position to the casting position to show the sixth side S6 of the rotatable apparatus 11. The sixth side S6 of the rotatable apparatus 11 includes a work deck 133 that has a four-sided opening 133*a* and communicating with the four-sided opening 133*a* are four openings 134, 135, 136 and 137 which are all kept closed, when not in operation, by four removeable plates 134*a*, 135*a*, 136*a* and 137*a*. Sixth side S6 includes a moveable transporter 138 with extensions 143, 144, 145 and 146 which fits over the four-sided opening 133*a* and the four openings 134, 135, 136 and 137, respectively. The four locators 139, 140, 141 and 142 are disposed in the openings 134, 135, 136 and 137, respectively, on the work deck 133. The cross support members 139*h*, 140*h*, 141*h* and 142*h* are welded to the sixth side S6 of the rotatable apparatus 11 and cooperate with locators 139, 140, 141 and 142 for securing and positioning transporter 138. The four locators 139, 140, 141 and 142 are positioned in cooperative relationship with the four extensions 143, 144, 145 and 146, respectively, of the transporter 138. A typical locator 139 is shown in FIG. 6.

Referring to FIGS. 4, 6, 8 and 14–17 of the drawing, the four locators 139, 140, 141 and 142 on the exterior surface S6*a* of the sixth side S6 are identical to each other and each includes an end stop 139*a* and two side stops 139*b* and 139*c*. The extensions 143, 144, 145 and 146 include four sets of shims which are designated as 139*d*, 139*e*, 139*f* and 139*g* that take up any slack from the extensions 143, 144, 145 and 146 of the transporter 138. The extensions 143, 144, 145 and 146 of the transporter 138 when placed in the locators 139, 140, 141 and 142 give rigidity and strength to the rotatable apparatus 11. The transporter 138 completes the sixth side S6 of the rotatable apparatus 11. The hoisting system 110, when locked to the four extensions 143, 144, 145 and 146 of the transporter 138, permits the rotatable apparatus 11 to rotate counter-clockwise 180 degrees to the load/unload position or to rotate clockwise 180 degrees to the casting position. As was aforementioned herein, if desired, the transporter 138 may be de-coupled or released from the hoisting system 110 wherein the blocks 121, 124, 127 and 130, may be held vertically by the retention devices 167, 168, 169 and 170, respectively. FIG. 5 shows blocks 127 and 130 held vertically by retention devices 169 and 170, respectively.

Referring to FIGS. 1, 2, 5, 6, 7 and 11 of the drawing, the rotatable apparatus 11 may be rotated 180 degrees to the casting position where the transporter 138 may be lifted above the four-sided opening 133*a*. This is accomplished by a jacking mechanism means 35 including truck 148 which lifts the transporter 138 by four holders 151, 152, 153 and 154 that engage hangers 155, 156, 157 and 158 of the transporter 138. The truck 148 lifts or lowers the transporter 138 onto, or off of, the four-sided opening 133*a* by machine screw actuators 159, 159*a*, 160 and 160*a*, an electro-mechanical jack responsive to an electrical control signal. The machine screw actuators 159, 159*a* 160 and 160*a* are hooked up to a retractable electric cord 161 which is connected to a power source 162. The truck 148 includes wheels 148*a*, 148*b*, 148*c*, 148*d* and rides on rails 163 and 163*a*. The rails 163 and 163*a* include four stops 165, 165*a*, 166 and 166*a* which are located on the end without stairway 15 and on rotatable apparatus 11, respectively, for stopping the truck 148.

Referring to FIGS. 1, 2, 3 and 5 of the drawing, the rotatable apparatus 11, if desired, may be shipped in three parts: a first part P1, a second part P2 and a third part P3 which are all bolted together by bolts 71, so that the molding machine may be assembled and disassembled in approximately ten foot sections for convenient shipment to different places not shown. In the event that such shipment is intended for parts P1, P2 and P3, then the tubular bars 72, 74, 91 and 93 are cut into three approximately equal sections and flanges 8 are welded to the tubular bars 72, 74, 91 and 93, and parts P1, P2 and P3 are assembled together with bolts 71. Also flanges 32 may be welded at the intersection of cross-members 86, 86*a* and 88, 88*a* of the third side S3 and the cross-members 102, 102*a* and 104, 104*a* of the fourth side S4. The parts P1, P2 and P3 are assembled together by inserting and fastening bolts 71*a* into flanges 32.

Referring to FIGS. 1, 3, 5, 6, 7, 9, 10 and 12 of the drawing, the molding machine 10 includes a mold 180. The mold 180 is disposed within the four-sided opening 133*a* of the sixth side S6 and is also disposed within the first side S1, the second side S2, the third side S3, the fourth side S4 and the fifth side S5 of the rotatable apparatus 11. The mold 180 includes a configuration form 181 which is fixed to the interior surface S5*b* of the fifth side S5. The configuration form 181 gives to the molded product 2 its overall shape and establishes the wall thickness of the molded product 2. The configuration form 181 partly determines the heights H2, H3 and H4 of the molded product 2. Referring to FIG. 9 of the drawing, the configuration form 181 is a composite of three configuration forms 181*a*, 181*b* and 181*c*, of three different heights which are available to produce products 2 of three different heights, namely H2 (eight feet, five and one-half inches), H3 (nine feet, five and one-half inches) and H4 (ten feet, five and one-half inches), respectively, or, if desired, of other heights. The configuration form 181 is disposed opposite to said opening 133*a* in the sixth side S6 of the rotatable apparatus 11. The configuration form 181 is an encircling arrangement with a ring-shaped floor 179 for casting said product 2 thereon, and having a given width between outside walls 179*a* and inside walls 179*b* of the configuration form 181.

Referring to FIGS. 2, 3, 3*a*, 9 and 25 of the drawing, the configuration forms 181*a*, 181*b* and 181*c* can be used to modify the wall thickness W1 of product 2 by adding two spacers 181*d* and two other spacers 181*e* to the configuration forms 181*a*, 181*b* and 181*c*, respectively, thereby changing wall thickness W1 to wall thickness W2. In this fashion, various wall thicknesses may be cast into the product 2. This casting is possible because the exterior wall forming panels 182, 183, 184 and 185 are moved to the configuration forms 181*a*, 181*b* and 181*c* by electro-mechanical devices such as machine screw actuators 211 and 211*a* as described in FIG. 5. Other actuating means may be used instead of the machine screw actuators 211 and 211*a* as described herein.

Referring to FIGS. 1, 2, 3, 5 and 6 of the drawing, the mold 180 includes exterior wall forming panel means 50 having four exterior wall forming panels 182, 183, 184 and 185 which are moveable with respect to the configuration form 181 in a parallel direction against the configuration form 181 or away from the configuration form 181. In order to maintain the parallel movement of the exterior wall forming panel 182 to move between the interior surface S3*b* of the third side S3 and the configuration form 181, two slide bearings 186 and 187 ride on two bearing shafts 190 and 191. "Machine screw actuator" is hereinafter abbreviated as MSA in the singlular and MSA's in the plural. MSA's 194 and 194*a* are fixed to tubular member 81.

Figure 7:
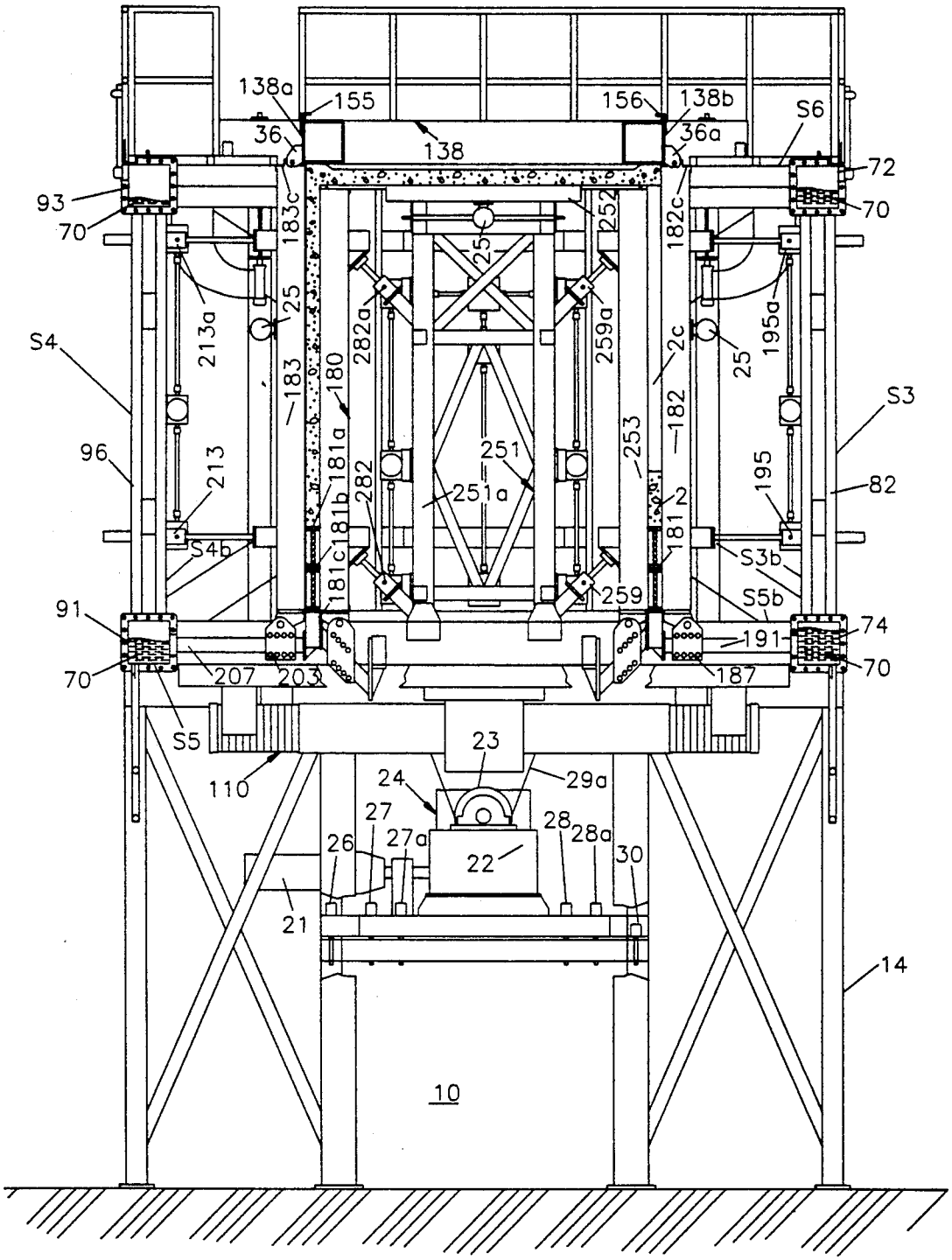
FIG. 7 is a cross-sectional view taken along lines 7—7 of FIG. 6, showing the casted product, with the rotatable apparatus in the casting position, and the transporter is held against the product by the hoisting system and the transporter connectors.
Figure 8:
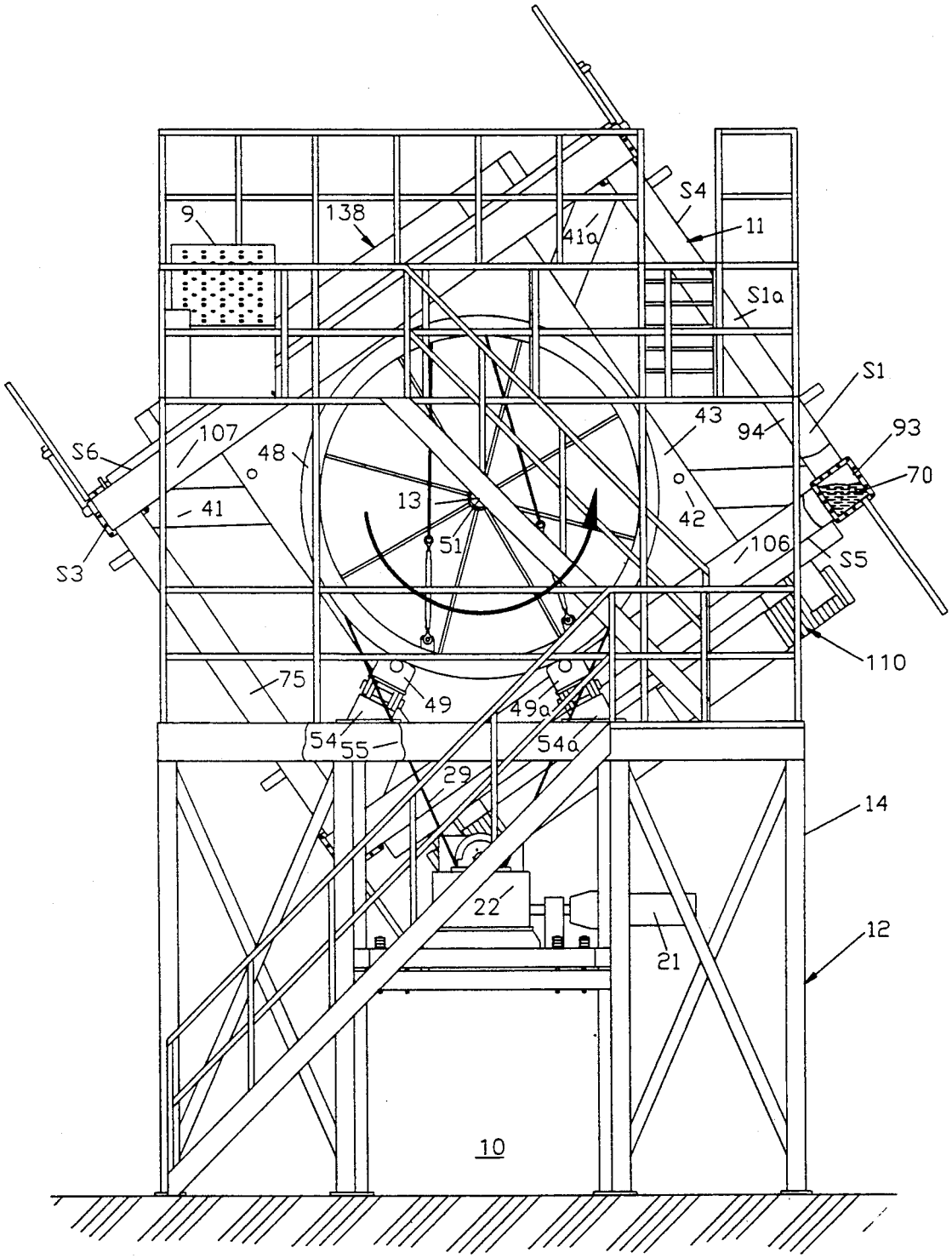
FIG. 8 is another left end view of the molding machine showing the rotatable apparatus being rotated counter-clockwise to the load/unload position, while the hoisting system and transporter connectors lock the transporter and secure the product in the mold and to the rotatable apparatus; apparatus.

MSA's 195 and 195*a* are fixed to tubular member 82. MSA's 196 and 196*a* are fixed to tubular member 83. MSA's 197 and 197*a* are fixed to tubular member 84. The purpose of the said cooperation between the MSA's 194, 194*a*, 195, 195*a*, 196, 196*a*, 197, and 197*a* with the two bearing shafts 190 and 191, and two slide bearings 186 and 187, is in order to move the wall forming panel 182 between the interior surface S3*b* of the third side S3 and the configuration form 181. The MSA's 194, 194*a*, 195, 195*a*, 196, 196*a*, 197 and 197*a* are fixed to the exterior wall forming panel 182 typically as shown in FIG. 7.

In order to maintain the parallel movement of the exterior wall forming panel 183 between the interior surface S4*b* of the fourth side S4 and the configuration form 181, two slide bearings 202 and 203 ride on two bearing shafts 206 and 207. MSA's 211 and 211*a* are fixed to tubular member 98. MSA's 212 and 212*a* are fixed to tubular member 97. MSA's 213 and 213*a* are fixed to tubular member 96. MSA's 214 and 214*a* are fixed to tubular member 95. The purpose of the said cooperation between the MSA's 211, 211*a*, 212, 212*a*, 213, 213*a*, 214, and 214*a* with bearing shafts 206, 207, and two slide bearings 202 and 203 is in order to move the exterior wall forming panel 183 between the interior surface S4*b* of the fourth side S4 and the configuration form 181. The MSA's 211, 211*a*, 212, 212*a*, 213, 213*a*, 214 and 214*a* are fixed to the exterior wall forming panel 183 as shown in FIG. 7.

The parallel movement of the exterior wall forming panel 184 is between the interior surface S1*b* of the first side S1 and the configuration form 181. Two slide bearings 219 and 220 are on two bearing shafts 221 and 222. MSA's 223 and 223*a* co-operate with bearing shaft 221; MSA's 225 and 225*a* co-operate with bearing shaft 222. The MSA's 223, 223*a*, 225 and 225*a* are attached to the interior surface S1*b* of side S1. The purpose of the said co-operation between the MSA's 223, 223*a*, 225 and 225*a*, respectively, with bearing shafts 221 and 222, and slide bearings 219 and 220, is to move the exterior wall forming panel 184 between the interior surface S1*b* of the first side S1 and the configuration form 181. The MSA's 223, 223*a*, 225 and 225*a* are fixed to the exterior wall forming panel 184 as shown in FIG. 3 of the drawing.

In order to maintain the parallel movement of the exterior wall forming panel 185 between the interior surface S2*b* of the second side S2 and the configuration form 181, two slide bearings 227 and 228 ride on two bearing shafts 229 and 230. MSA's 231 and 231*a* co-operate with bearing shaft 229; MSA's 233 and 233*a* co-operate with bearing shaft 230. The MSA's 231, 231*a*, 233 and 233*a* are attached to the interior surface S2*b* of the side S2. The purpose of the said co-operation between the MSA's 231, 231*a*, 233 and 233*a*, respectively, with bearing shafts 229 and 230, and slide bearings 227 and 228, is to move the exterior wall forming panel 185 between the interior surface S2*b* of second side S2 and the configuration form 181. The MSA's 231, 231*a*, 233 and 233*a* are fixed to the exterior wall forming panel 185 as shown in FIG. 3 of the drawing.

Referring to FIGS. 3, 5, 10, 11, 12, 12*a*, 18 and 20 of the drawing, six locating pins 235 located on interior surface 184*b* of exterior wall forming panel 184 locate and align with three bushings 235*a* located on bushing end 182*d* of exterior wall forming panel 182 and three bushings 235*a* located on the bushing end 183*d* of exterior wall forming panel 183. Six other locating pins 236 located on the interior surface 185*b* of exterior wall forming panel 185 locate and align with three bushings 236*a* located on the bushing end 182*e* of exterior wall forming panel 182 and three bushings 236*a* located on bushing end 183*e* of exterior wall forming panel 183. All bushings 235*a* and 236*a* are not shown in FIGS. 11 and 12 of the drawing. When the exterior wall forming panels 182 and 183 are contiguous to the configuration form 181, the bushings 235*a* and 236*a* are in alignment with the corresponding pins 235 and 236 of exterior wall forming panels 184 and 185, respectively. When the locating pins 235 and 236 are located within the corresponding bushings 235*a* and 236*a*, the exterior wall forming panels 182 and 183 are locked therein by the exterior wall forming panels 184 and 185, respectively.

Figure 3:
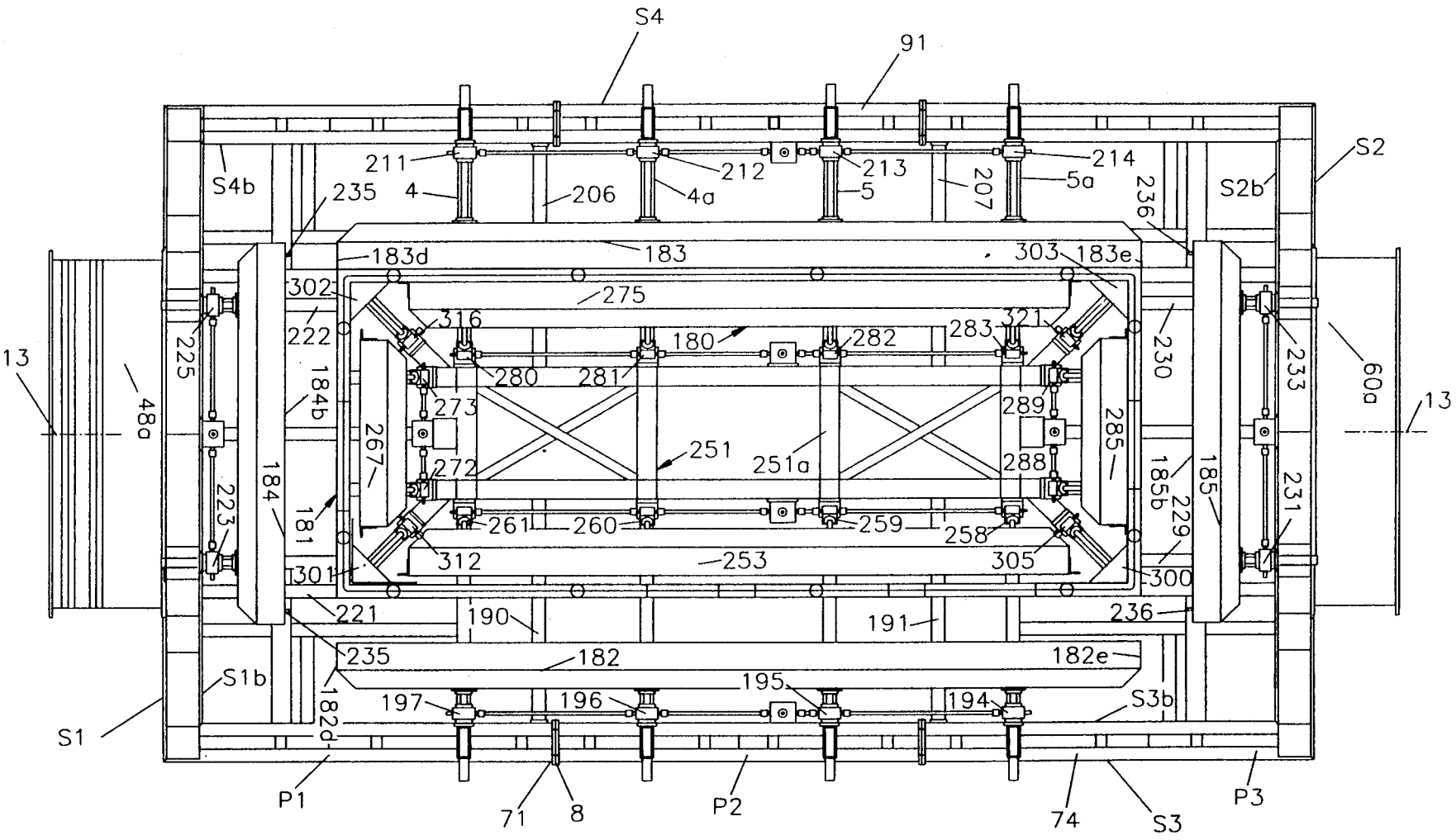
FIG. 3 is a partial, cross-sectional view taken along line 3—3 of FIG. 2, showing the rotatable apparatus and the mold of FIGS. 1 and 2.
Figure 3A:
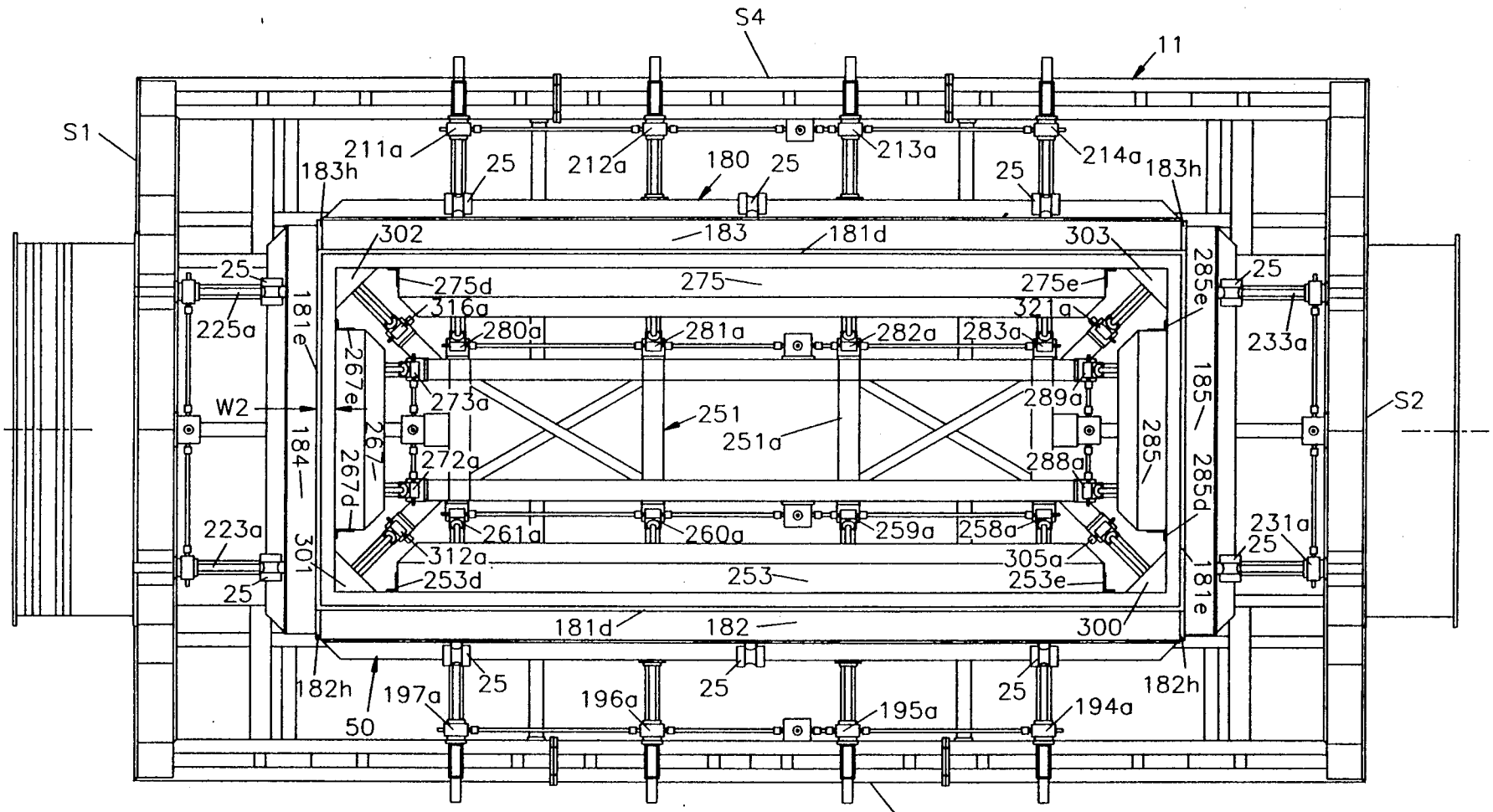
FIG. 3*a* is similar to FIG. 3, except it is taken through line 3*a*–3*a* of FIG. 2, showing the rotatable apparatus and the mold.

Referring to FIGS. 3 and 3*a* of the drawing, it may now be seen that when the configuration form 181 is changed dimensionally to give a thicker wall W2 or thinner wall W1, the pins 235 and 236, or the bushings 235*a* and 236*a*, must also be changed to allow for the interior width changes in the exterior wall forming panels 184 and 185, respectively. For example, the preferred embodiment of the invention may include two spacers 182*h* which are fastened to the bushing ends 182*d* and 182*e* of exterior wall forming panel 182, while two other spacers 183*h* may be fastened to the bushing ends 183*d* and 183*e* so that the exterior wall forming panels 184 and 185, and their corresponding pins 235 and 236, are in alignment with the exterior wall forming panels 182 and 183 which are contiguous with the configuration form 181.

Figure 13:
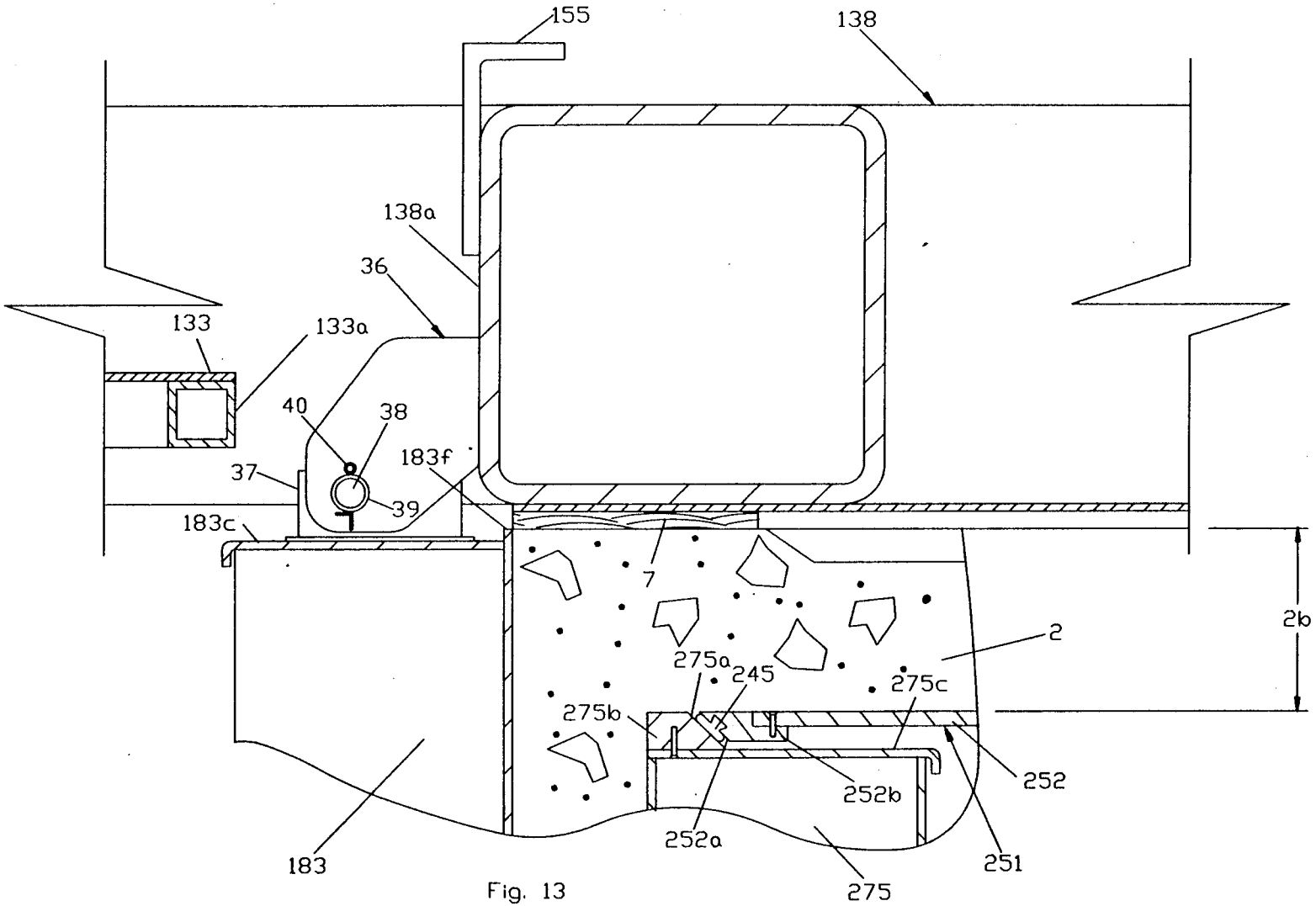
FIG. 13 is a partial, fragmentary view of the mold and the transporter and one of the transporter locking connectors between the transporter and an exterior wall forming panel which is part of the mold.
Figure 14:
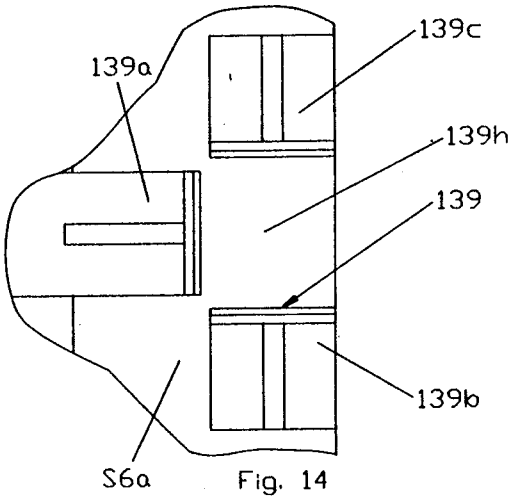
FIG. 14 is a partial, fragmentary, plan view of one of the locators used in locating and aligning one of the extensions of the transporter on the rotatable apparatus.
Figure 15:
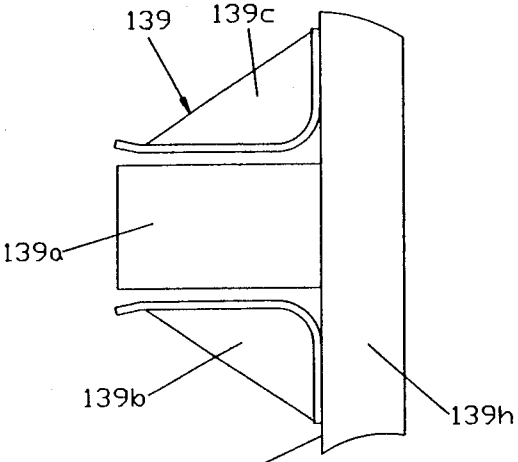
FIG. 15 is a partial, fragmentary, front view showing the locator depicted in FIG. 14.
Figure 18:
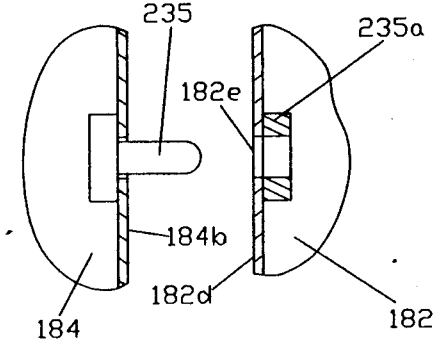
FIG. 18 shows a cross-sectional view of a locating pin of an exterior wall forming panel and a corresponding bushing in another exterior wall forming panel for locating, aligning and locking the exterior wall forming panels.
Figure 16:
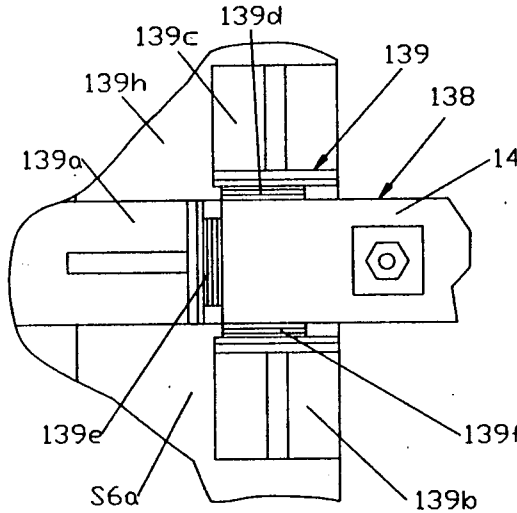
FIG. 16 shows a partial, fragmentary, plan view similiar to FIG. 14, except that one of the extensions of the transporter is shown within the locator and a shim set is used to align and stabilize the transporter extension in the locator.
Figure 17:
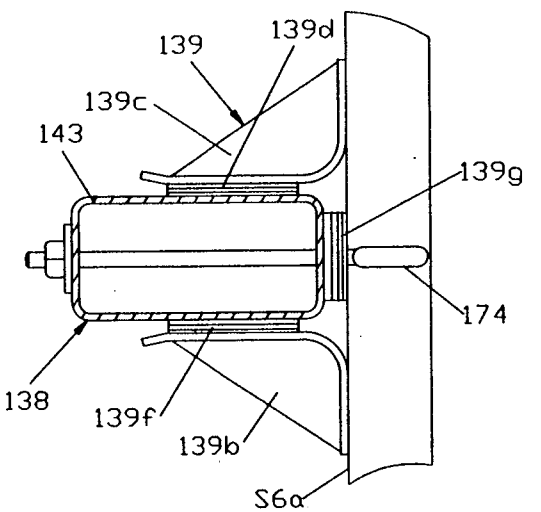
FIG. 17 shows a partial, fragmentary, cross-sectional, front view of the transporter extension in the locator.

Referring to FIGS. 7 and 13 of the drawing, there is shown a transporter connector 36 which connects one side 138*a* of the transporter 138 to the top edge 183*c* of the exterior wall forming panel 183. The transporter connector 36 includes a transporter block 37 fixed to the top edge 183*c* of the exterior wall forming panel 183. The transporter block 37 is fixed to the transporter connector 36 by a transporter pin 38 in a hole 39 which interconnects the transporter connector 36 to the block 37. The transporter connector 36 may be coupled or de-coupled by removing the transporter pin 38 by first removing the cotter key 40 from the transporter pin 38 and removing the transporter pin 38 from the hole 39. Transporter connector 36*a* connects another side 138*b* of the transporter 138 to the top edge 182*c* of the exterior wall forming panel 182. The transporter connector 36*a* is the same as transporter connector 36 and, therefore, all of the foregoing parts enumerated for transporter connector 36 are incorporated herewith and referred to transporter connector 36*a*. The transporter block 37 which is fixed to the top edge 183*c* of the exterior wall forming panel 183 has clearance from the work deck 133, so that the exterior wall forming panel 183 may slide underneath the work deck 133 when opening in the load/unload position.

Figure 10:
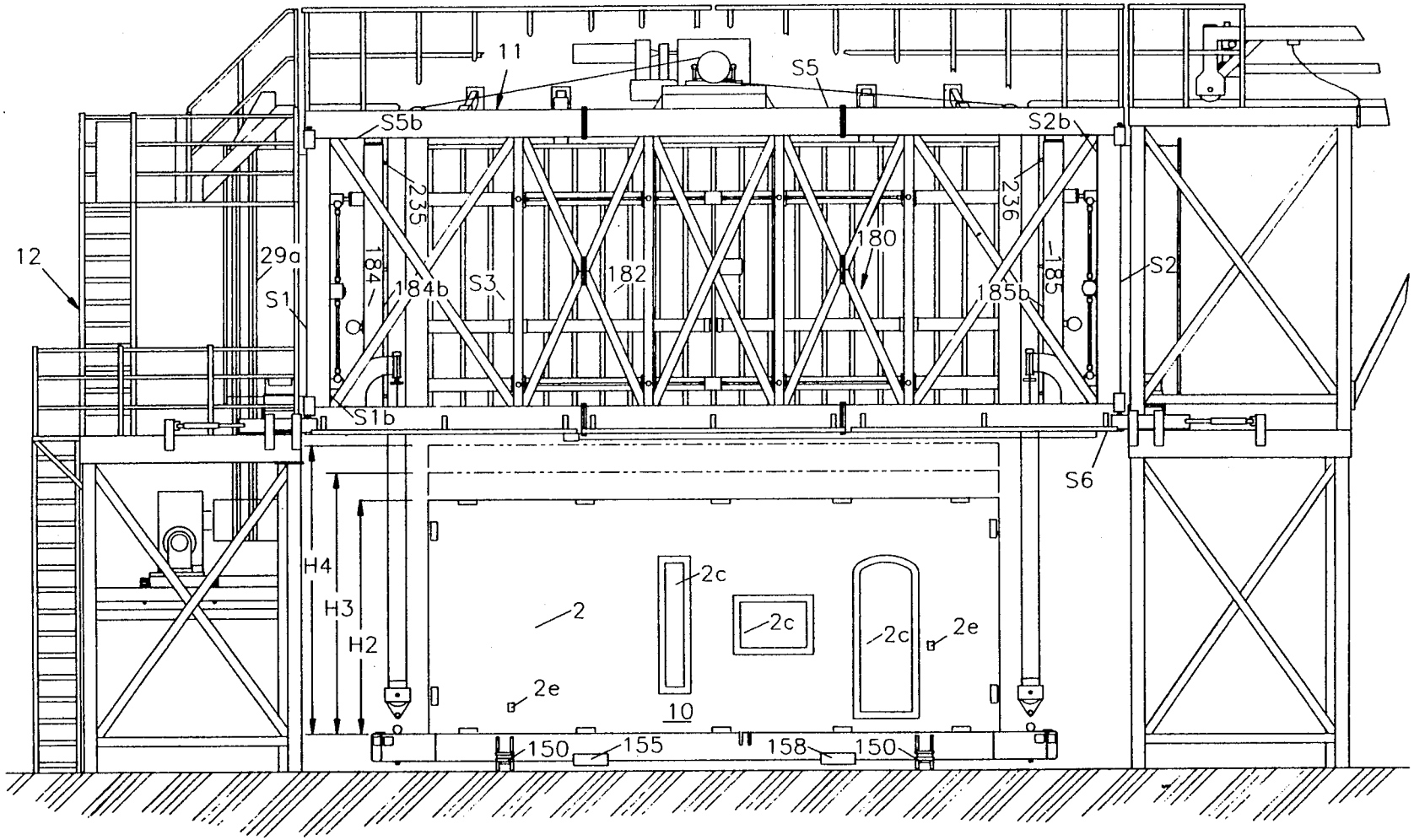
FIG. 10 shows a front view of the molding machine which is similar to FIG. 2, with a finished product supported by a transporter, and shows that the hoisting system has been disengaged from the transporter, while the rotatable apparatus is in the load/unload position.

Referring to FIGS. 3, 3*a*, 7, 9, 12, 12*a*, 13, 19, 20, 21, 22, 23, 24 and 25 of the drawing, there is shown an inner core assembly 251 of the mold 180. The inner core assembly 251 is fixed to the interior surface S5*b* of the fifth side S5 of the rotatable apparatus 11, and is located within the configuration form 181. The inner core assembly 251 includes an inner core frame 251*a* which is fastened to the interior surface S5*b* of the fifth side S5 of the rotatable apparatus 11. The inner core assembly 251 includes a stationary floor forming panel 252 which is spaced from the configuration form 181 and fixed to the inner core frame 251*a*. Co-operating with the floor forming panel 252 and the configuration form 181 are four corner forming panels 300, 301, 302 and 303, and four interior wall forming panels 253, 267, 275 and 285. When the four corner forming panels 300, 301, 302 and 303, and the four interior wall forming panels 253, 267, 275 and 285, are placed in the casting mode with each other they enclose the inner core assembly 251 of the mold 180. Furthermore, when the exterior wall forming panels 182, 183, 184 and 185, together with the inner core assembly 251 are sealed shut, they are all against the configuration form 181. The product 2 is then cast in the mold 180. When the product 2 is partially cured, and supports itself, in the mold 180, the transporter 138 is carried by the truck 148 and is placed over the product 2. The transporter 138 is then coupled to the hoisting system 110 and locked into the locators 139, 140, 141 and 142, and secured to the exterior wall forming panels 182 and 183, by means of transporter connectors 36 and 36*a*. The mold 180 and the rotatable apparatus 11 are then rotated 180 degrees from the casting position to the load/unload position and the transporter connectors 36 and 36*a* are released from the transporter 138. The four exterior wall forming panels 182, 183, 184 and 185 are pulled away from the product 2, the four interior wall forming panels 253, 267, 275 and 285, are pulled away from the product 2 and then the four corner forming panels 300, 301, 302 and 303, are pulled away from the product 2, thereby leaving the product 2 on the transporter 138, while the transporter 138 is supported by the hoisting system 110. The hoisting system 110 then lowers the transporter 138, with the product 2 thereon, to the floor 16, as shown in FIG. 10 of the drawing. In the next cycle of operation, the reinforcing cage 3, supported by the transporter 138 is raised into the mold 180 by the hoisting system 110, while the rotatable apparatus 11 of the molding machine 10 is in the load/unload position. The corner forming panels 300, 301, 302 and 303 are moved to the configuration form 181 and the floor forming panel 252. Then the interior wall forming panels 253, 267, 275 and 285 are moved to the configuration form 181, and against the corner forming panels 300, 301, 302 and 303, and the floor forming panel 252. The inner core assembly 251 is thereby completely closed. The exterior wall forming panels 182 and 183 are drawn to the configuration form 181, and then exterior wall forming panels 184 and 185 are drawn together and locked to the configuration form 181. The mold 180 is thereby completely closed and is ready to be rotated 180 degrees with the rotatable apparatus 11 to the casting position from the load/unload position.

The interior wall forming panels 253, 267, 275 and 285 and the corner forming panels 300, 301, 302 and 303, and the floor forming panel 252, will now be described in detail. The inner core assembly 251 is fixed to the interior surface S5*b* of the fifth side S5 and located approximately five and one-half inches from each of the screeding edges 182*f*, 183*f*, 184*f* and 185*f* of the exterior wall forming panels 182, 183, 184 and 185. This dimension of five and one-half inches determines the floor thickness of the product 2. At five and one-half inches from the screeding edges 182*f*, 183*f*, 184*f* and 185*f* of the exterior wall forming panels 182, 183, 184 and 185 is the inner core floor forming panel 252.

The floor forming panel 252 is fastened to an inner core frame 251*a* of the inner core assembly 251. The inner core frame 251*a* is fixed to the interior surface S5*b* of fifth side S5 of the rotatable apparatus 11 and the inner core frame 251*a* is disposed within the configuration form 181. The floor forming panel 252 includes a floor forming panel insert 252*b* which includes a bevelled edge 252*a* over the entire perimeter of the floor forming panel 252. The bevelled edge 252*a* slants at an angle towards itself. The floor forming panel insert 252*b* includes a synthetic material seal 245 which seals the entire perimeter of the floor forming panel 252 as shown in FIG. 13 of of the drawing. The floor forming panel 252 is located at a certain distance from the casting floor 179 of the configuration form 181. When the product 2 has an eight foot, five and one-half inches exterior dimension, and the floor thickness 2*b* of the product 2 has a thickness of five and one-half inches, then the floor forming panel 252 is located eight feet from the casting floor 179 of the configuration form 181. The over-all heights H2, H3 and H4 of the product 2 are determined by the measurement of the distance from the casting floor 179 of the configuration form 181 to the screeding edges 182*f*, 183*f*, 184*f* and 185*f* of the exterior wall forming panels 182, 183, 184 and 185, respectively.

Co-operating with the floor forming panel 252 is an interior wall forming panel 253 which includes a corresponding wear shoe 253*b* that is in sealing relationship with the bevelled edge 252*a* and the synthetic material seal 245 of the floor forming panel 252 when in the casting position. The wear shoe 253*b* has a bevelled edge 253*a* that forms a complementary angle with the bevelled edge 252*a* of the floor forming panel insert 252*b*. The wear shoe 253*b* is fixed to the top edge 253*c* of the interior wall forming panel 253. The interior wall forming panel 253 is moveable at an angle with respect to the configuration form 181 and the floor forming panel 252 which are stationary. The interior wall forming panel 253 not only moves angulary with respect to the configuration form 181 and the inner core floor forming panel 252, but the interior wall forming panel 253 also moves parallel with the configuration form 181. This angular and parallel movement of the interior wall forming panel 253 is important because the interior wall forming panel 253 may easily be released from the casted product 2. The interior wall forming panel 253 is suspended by sleeve bearings 254 and 255 which slide along two shafts 254*a* and 255*a* which are positioned at an angle. The interior wall forming panel 253 is moved angularly by MSA's 258, 259, 260 and 261; and MSA's 258*a*, 259*a* , 260*a* and 261*a*. The wear shoe 253*b* of the interior wall forming panel 253 has outboard edges 266 and 266*a* which are angled inward and co-operate with corner forming panels 300 and 301, respectively. Furthermore, looking at FIGS. 23 and 24, it can be seen that the interior wall forming panel 253 includes angle bracket 253*d* on the interior wall forming panel 253, and, opposite to angle bracket 253*d* is another angle bracket 253*e* which brace against corner forming panels 300 and 301.

Co-operating with the inner core floor forming panel 252 is an interior wall forming panel 267 which includes a corresponding wear shoe 267*b* that is in sealing relationship with the bevelled edge 252*a* and the synthetic material seal 245 of the inner core floor forming panel 252 when in the casting position. The wear shoe 267*b* has a bevelled edge 267*a* that forms a complementary angle with the bevelled edge 252*a* of the floor forming panel insert 252*b*. The wear shoe 267*b* is fixed to the top edge 267*c* of the interior wall forming panel 267. The interior wall forming panel 267 is moveable at an angle with respect to the configuration form 181 and the floor forming panel 252 which are stationary. The interior wall forming panel 267 not only moves angulary with respect to the configuration form 181 and the inner core floor forming panel 252, but the interior wall forming panel 267 also moves parallel with the configuration form 181. This angular and parallel movement of the interior wall forming panel 267 is important because the interior wall forming panel 267 may easily be released from the casted product 2. The interior wall forming panel 267 is suspended by sleeve bearings 268 and 269 which slide along two shafts 268*a* and 269*a* which are positioned at an angle. Referring to FIGS. 3, 3A, 23 and 24 of the drawing, the interior wall forming panel 267 is moved angularly by MSA's 272, 272*a* and 273, 273*a*. The wear shoe 267*b* of the interior wall forming panel 267 has outboard edges 274 and 274*a* which are angled inward and cooperate with corner forming panels 302 and 301, respectively. It can be seen that the interior wall forming panel 267 includes angle bracket 267*d* on the interior wall forming panel 267 and, opposite to angle bracket 267*d*, is another angle bracket 267*e*, which braces against corner forming panels 301 and 302.

Co-operating with the floor forming panel 252 is an interior wall forming panel 275 which includes a corresponding wear shoe 275*b* that is in sealing relationship with the bevelled edge 252*a* and the synthetic material seal 245 of the floor forming panel 252 when in the casting position. The wear shoe 275*b* has a bevelled edge 275*a* that forms a complementary angle with the bevelled edge 252*a* of the floor forming panel insert 252*b*. The wear shoe 275*b* is fixed to the top edge 275*c* of the interior wall forming panel 275. The interior wall forming panel 275 is moveable at an angle with respect to the configuration form 181 and the floor panel 252 which are stationary. The interior wall forming panel 275 not only moves angulary with respect to the configuration form 181 and the inner core floor forming panel 252, but the interior wall forming panel 275 also moves parallel with the configuration form 181. This angular and parallel movement of the interior wall forming panel 275 is important because the interior wall forming panel 275 may easily be released from the casted product 2. The interior wall forming panel 275 is suspended by sleeve bearings 276 and 277 which slide along two shafts 276*a* and 277*a* which are positioned at an angle. The interior wall forming panel 275 is moved angularly by MSA's 280 and 280*a* and MSA's 281 and 281*a*, MSA's 282 and 282*a*, MSA's 283 and 283*a*. The wear shoe 275*b* of the interior wall forming panel 275 has outboard edges 284 and 284*a* which are angled inward and cooperate with corner forming panels 302 and 303, respectively. Furthermore, looking at FIGS. 3, 3A and 19, it can be seen that the interior wall forming panel 275 includes angle bracket 275*d* on the interior wall forming panel 275, and, opposite to angle bracket 275*d*, another angle bracket 275*e* which braces against corner forming panels 302 and 303.

Co-operating with the inner core floor forming panel 252 is an interior wall forming panel 285 which includes a corresponding wear shoe 285*b* that is in sealing relationship with the bevelled edge 252*a* and the synthetic material seal 245 of the inner core floor forming panel 252 when in the casting position. The wear shoe 285*b* has a bevelled edge 285*a* that forms a complementary angle with the bevelled edge 252*a* of the floor forming panel insert 252*b*. The wear shoe 285*b* is fixed to the top edge 285*c* of the interior wall forming panel 285. The interior wall forming panel 285 is moveable at an angle with respect to the configuration form 181 and the floor forming panel 252 which are stationary. The interior wall forming panel 285 not only moves angulary with respect to the configuration form 181 and the inner core floor forming panel 252, but the interior wall forming panel 285 also moves parallel with the configuration form 181. This angular and parallel movement of the interior wall forming panel 285 is important because the interior wall forming panel 285 may easily be released from the casted product 2. The interior wall forming panel 285 is suspended by sleeve bearings 286 and 287 which slide along two shafts 286*a* and 287*a* which are positioned at an angle. The interior wall forming panel 285 is moved angularly by MSA's 288 and 288*a*, and MSA's 289 and 289*a*. The wear shoe 285*b* of the interior wall forming panel 285 has outboard edges 290 and 290*a* which are angled inward and cooperate with corner forming panels 300 and 303, respectively. Furthermore, looking at FIG. 3*a*, it can be seen that the interior wall forming panel 285 includes angle bracket 285*d* on the interior wall forming panel 285, and, opposite to angle bracket 285*d*, another angle bracket 285*e* which braces against corner forming panels 300 and 303.

Co-operating with the inner core floor forming panel 252 is a corner forming panel 300 which has a corresponding wear shoe 300*b* and a bevelled edge 300*a* that is in sealing relationship with the bevelled edge 252*a* through synthetic material seal 245. Co-operating with interior wall forming panels 253 and 285 is corner forming panel 300 which moves prior to interior wall forming panels 253 and 285 and angularly with respect to the interior wall forming panels 253 and 285 and the configuration form 181 when moving into the casting position.

Figure 12:
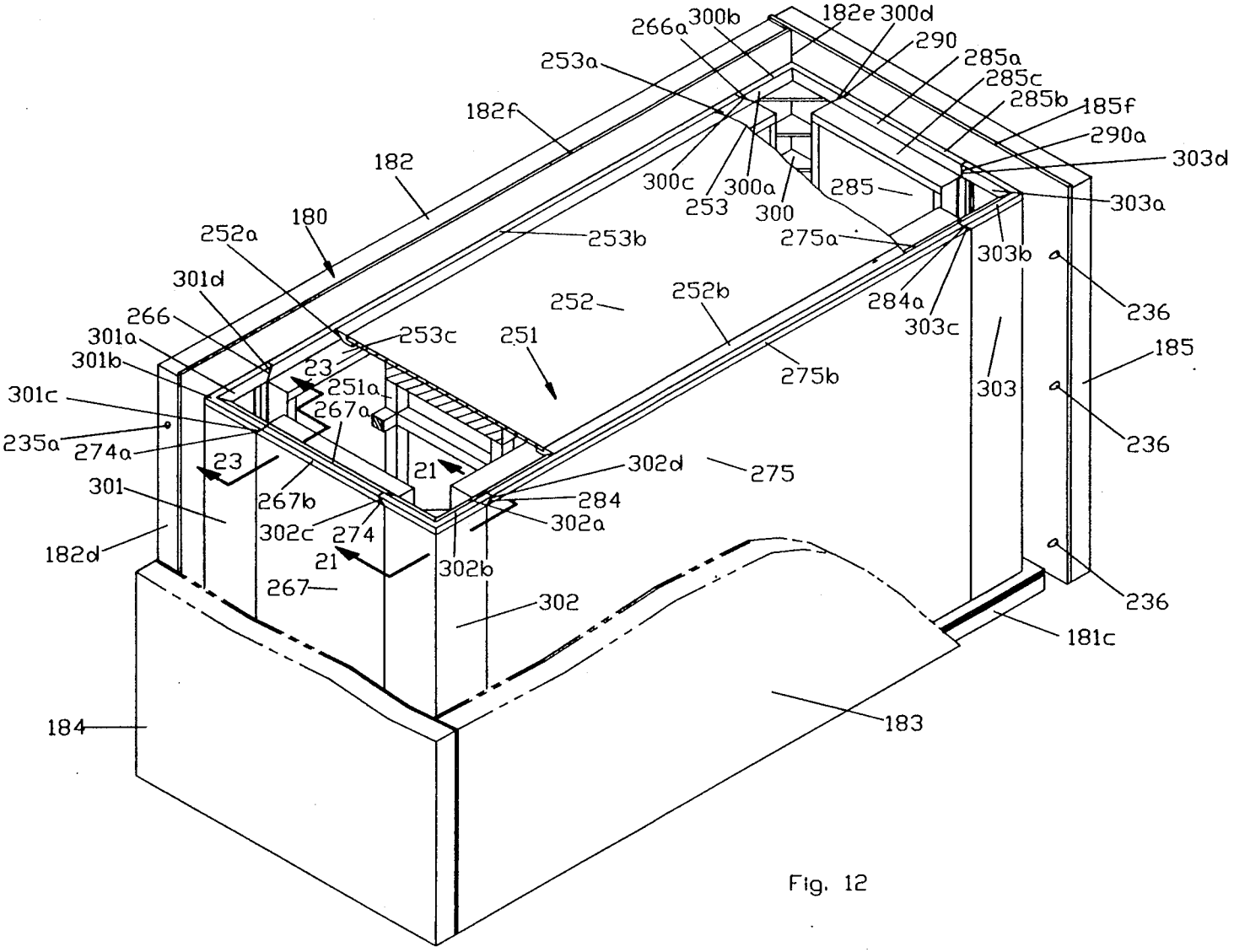
FIG. 12 is a partial, fragmentary view of the inner core assembly and its co-action with the configuration form and the exterior wall forming panels.

The outboard edges 300*c* and 300*d* of wear shoe 300*b* include a synthetic material seal 246 that is in sealing relationship with outboard edges 266*a* and 290 of wear shoes 253*b* and 285*b*, respectively. The synthetic material seal 246 is perpendicular to the synthetic material seal 245 when the corner forming panel 300 and the interior wall forming panels 253 and 285 are disposed in the casting position as shown in FIG. 12 of the drawing. The synthetic material seals 245 and 246 provide a sealing effect between the floor forming panel 252, the corner forming panel 300 and the interior wall forming panels 253 and 285.

Corner forming panel 300 moves angularly with respect to the configuration form 181 on sleeve bearing 304 which slides along a bearing shaft 304*a*. Two parallel MSA's 305 and 305*a* angularly move the corner forming panel 300 against the configuration form 181 for casting the product 2 and, after rotating the rotatable apparatus 11 180 degrees and angularly moving away from the configuration form 181, discharges the product 2.

Co-operating with interior wall forming panels 253 and 267 is a corner forming panel 301 which has a corresponding wear shoe 301*b* and a bevelled edge 301*a* that is in sealing relationship with bevelled edge 252*a* and synthetic material seal 245.

The outboard edges 301*c* and 301*d* of wear shoe 301*b* includes a synthetic material seal 246 that is in sealing relationship with outboard edges 274*a* and 266 of wear shoes 267*b* and 253*b*, respectively. The synthetic material seal 246 is perpendicular to the synthetic material seal 245, when the corner forming panel 301 and the interior wall forming panels 253 and 267 are disposed in the casting position as shown in FIG. 12 of the drawing. The synthetic material seals 245 and 246 provide a sealing effect between the floor forming panel 252, the corner forming panel 301 and the interior wall forming panels 253 and 267.

The corner forming panel 301 moves prior to interior wall forming panels 253 and 267 and angularly with respect to the interior wall forming panels 253 and 267 when going into the casting mode. Corner forming panel 301 moves angularly with respect to the configuration form 181 on sleeve bearing 310 which slides along a bearing shaft 310*a*. Two parallel MSA's 312 and 312*a* angularly move the corner forming panel 301 against the configuration form 181 for the purpose of casting the product 2. For the purpose of discharging the product 2, the rotatable apparatus 11 is rotated 180 degrees and the two MSA's 312 and 312*a* angularly move the corner forming panel 301 away from the configuration form 181.

Co-operating with interior wall forming panels 267 and 275 is an corner forming panel 302 which has a corresponding wear shoe 302*b* and a bevelled edge 302*a* that is in sealing relationship with the bevelled edge 252*a* through synthetic material seal 245. The corner forming panel 302 moves prior to the interior wall forming panels 267 and 275 and angularly with respect to the interior wall forming panels 267 and 275 when moving into the casting mode. The corner forming panel 302 moves angularly with respect to the configuration form 181 on sleeve bearing 314 which slides along a bearing shaft 314*a*. MSA's 316 and 316*a* angularly move the corner forming panel 302 against the configuration form 181 or away from the configuration form 181 as stated hereinabove.

The outboard edges 302*c* and 302*d* of wear shoe 302*b* includes a synthetic material seal 246 that is in sealing relationship with outboard edges 274 and 284 of wear shoe 267*b* and 275*b*, respectively. The synthetic material seal 246 is perpendicular to the synthetic material seal 245, when in the casting mode as shown in FIG. 12 of the drawing.

Co-operating with interior wall forming panels 275 and 285 is a corner forming panel 303 which has a corresponding wear shoe 303*b* and a bevelled edge 303*a* that is in sealing relationship with the bevelled edge 252*a* through synthetic material seal 245. The corner forming panel 303 moves angularly with respect to the interior wall forming panels 275 and 285 and the configuration form 181. Corner forming panel 303 moves angularly with respect to the configuration form 181 on sleeve bearing 318 which slides along a bearing shaft 318*a*. Two MSA's 321 and 321*a* angularly move the corner forming panel 303 against the configuration form 181 for the purpose of casting the product 2 or away from the configuration form 181 as stated hereinabove.

The outboard edges 303*c* and 303*d* of wear shoe 303*b* include a synthetic material seal 246 that is in sealing relationship with outboard edges 284*a* and 290*a* of wear shoes 275*b* and 285*b*, respectively.

Figure 19:
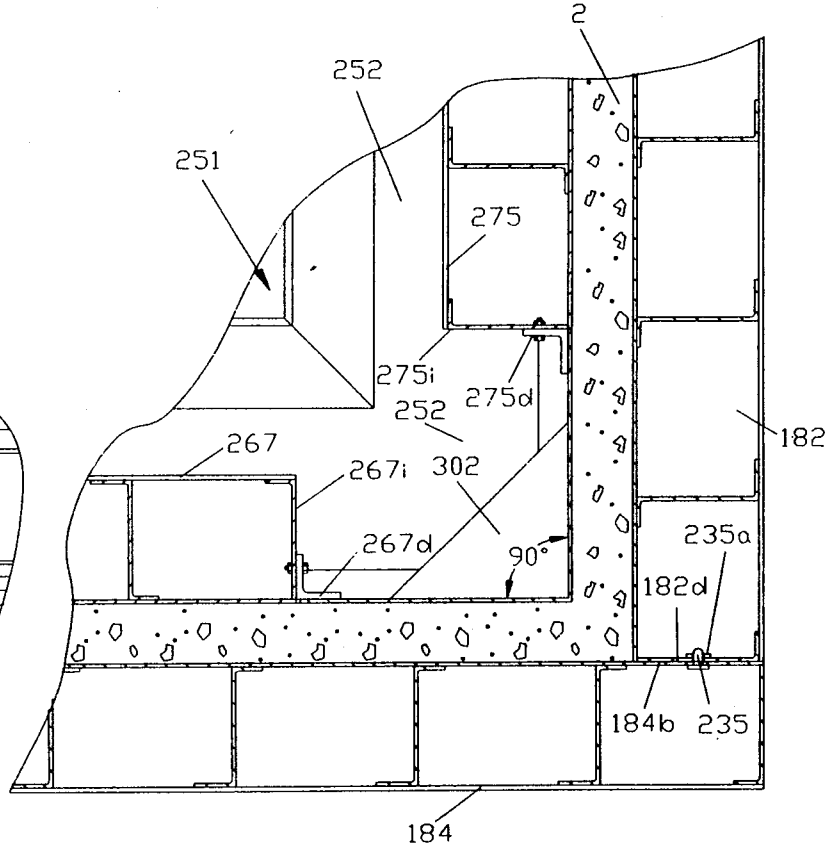
FIG. 19 is a partial, cross-sectional view, taken through line 19—19 of FIG. 12*a*, of the rotatable apparatus in the casting position.
Figure 20:
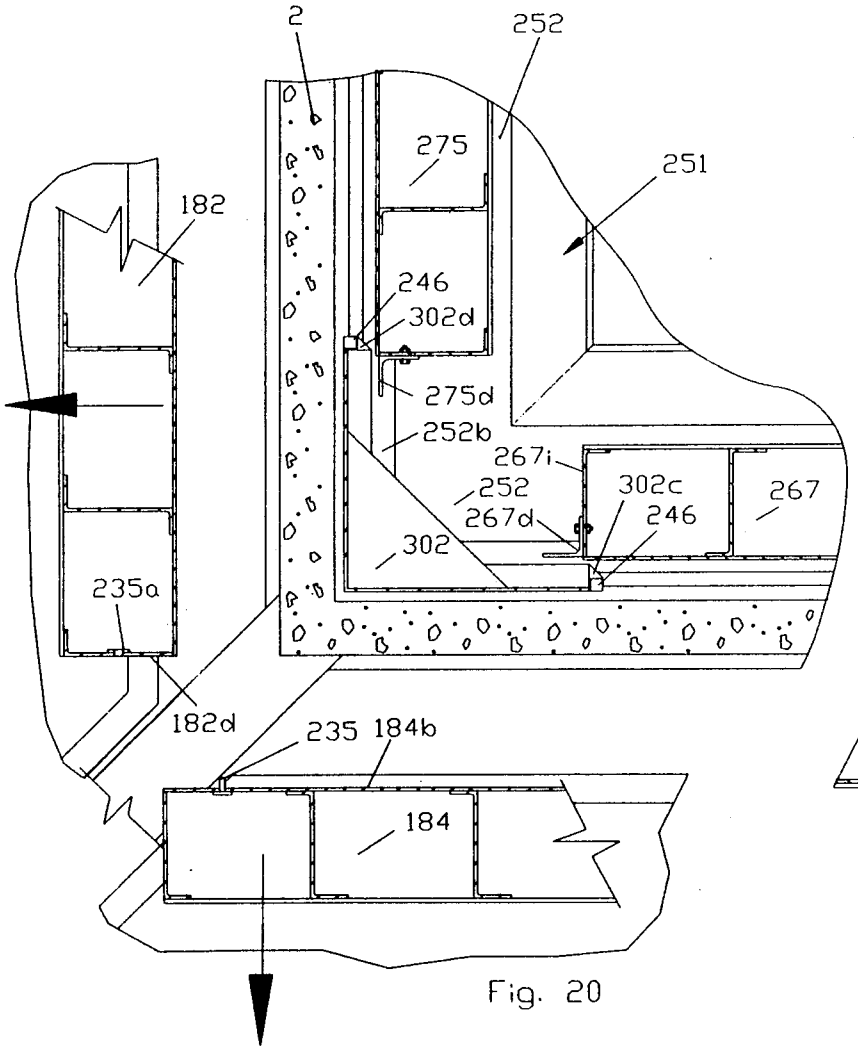
FIG. 20 is like FIG. 19, except that FIG. 20 shows an internal, partial, fragmentary, cross-sectional view of the rotatable apparatus rotated 180 degrees to the load/unload position and the mold is in the release mode.

Referring to FIGS. 19 and 20 of the drawing, there is shown a cross-sectional view depicting the exterior wall forming panels 182 and 184 and the inner core assembly 251 in the casting position and the load/unload position, respectively. Referring to FIG. 19 of the drawing, there is shown the casted product 2 with the exterior wall forming panels 182 and 184 in the casting position, that is, the exterior wall forming panels 182 and 184 are locked into position by the locking pin 235 and bushing 235*a* on the internal surface 184*b* and the bushing edge 182*d*. There is also shown the inner core assembly 251 and the floor forming panel 252 with the corner forming panel 302 against the casted product 2 while the interior wall forming panels 267 and 275, respectively, are against the casted product 2 and the angle brackets 267*d* and 275*d* press against the corner forming panel 302. The angle bracket 267*d* is fixed to the angle bracket end 267*i* of the interior wall forming panel 267. The angle bracket 275*d* is fixed to the angle bracket end 275*i* of the interior wall forming panel 275.

Referring to FIG. 20 of the drawing, the rotatable apparatus 11 has been rotated 180 degrees from the casting position to the load/unload position. In the load/unload position, the exterior wall forming panels 182 and 184 release the casted product 2 by moving away from the casted product 2. The interior wall forming panels 267 and 275 move away from the casted product 2, thereby releasing the casted product 2 from the interior wall forming panels 267 and 275. When the interior wall forming panels 267 and 275 are moved away from the casted product 2, the angle brackets 267*d* and 275*d* also move away from the corner forming panel 302. The interior wall forming panels 267 and 275 move angularly away from the inner core floor forming panel 252 and the configuration form 181 while moving parallel to the configuration form 181 to thereby release the interior wall forming panels 267 and 275 from the casted product 2. Lastly, the corner forming panel 302, which has been released from the angle brackets 267*d* and 275*d*, is also released from the casted product 2 by moving at an angle from the inner core floor forming panel 252 and configuration form 181, while maintaining a parallel relationship to configuration form 181.

Figure 21:
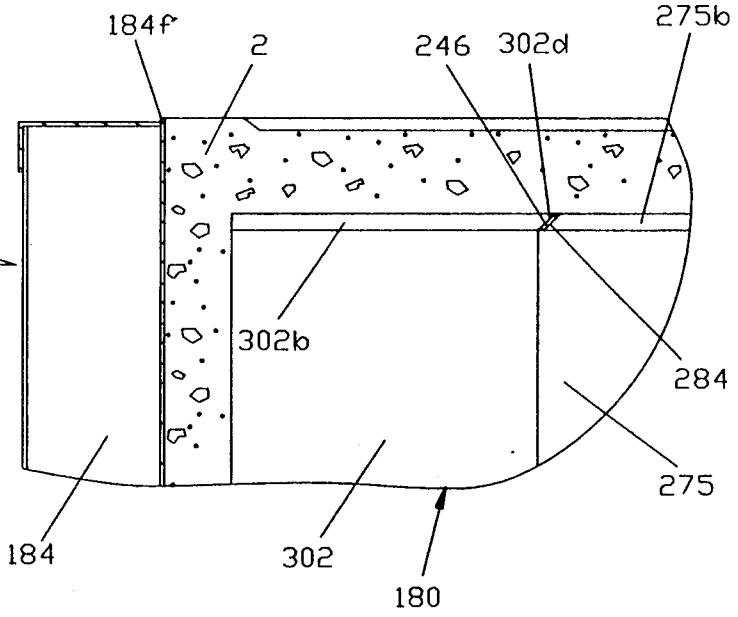
FIG. 21 is a partial, fragmentary, cross-sectional view of the rotatable apparatus shown in the casting position, taken along line 21—21 of FIG. 12.
Figure 22:
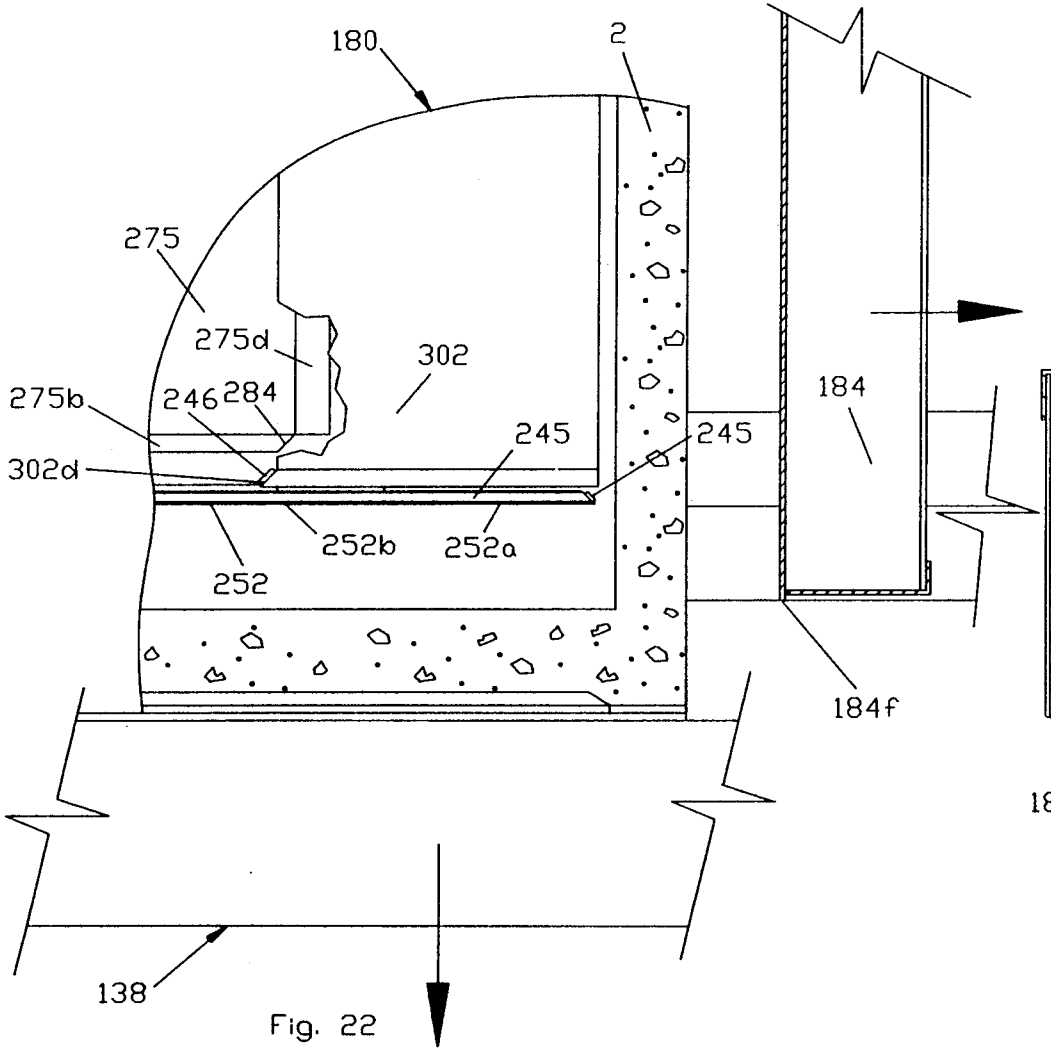
FIG. 22 is similiar to the view given in FIG. 21, except that FIG. 22 shows a partial, fragmentary, cross-sectional view of the rotatable apparatus which has been moved 180 degrees into the load/unload position and the mold is in the release mode.

Referring to FIG. 21 and 22 of the drawing, there is shown a casted product 2 in the casting position, and a casted product 2 is shown in the load/unload position, respectively. Referring to FIG. 21 of the drawing, there is shown an exterior wall forming panel 184 against the casted product 2. The corner forming panel 302 and the interior wall forming panel 275 co-operate to form the casted product 2. The interior wall forming panel 275 and the wear shoe 275*b* press against the corner forming panel 302 at outboard edge 284 to produce a squeezing effect on the synthetic material seal 246 therebetween. FIG. 22 of the drawing shows a casted product released by the mold 180 and supported by the transporter 138. The exterior wall forming panel 184 is moved away from the casted product 2, thereby releasing the casted product 2. The interior wall forming panel 275 is moved at an angle from the inner core floor forming panel 252 and the configuration form 181, while maintaining a parallel relationship with the configuration form 181. The angle bracket 275*d* of the interior wall forming panel 275 releases the corner forming panel 302 so that the corner forming panel 302 is also released from the casted product 2 and moves, at an angle, from the inner core floor forming panel 252 and the configuration form 181, while maintaining a parallel relationship with the configuration form 181.

Figure 23:
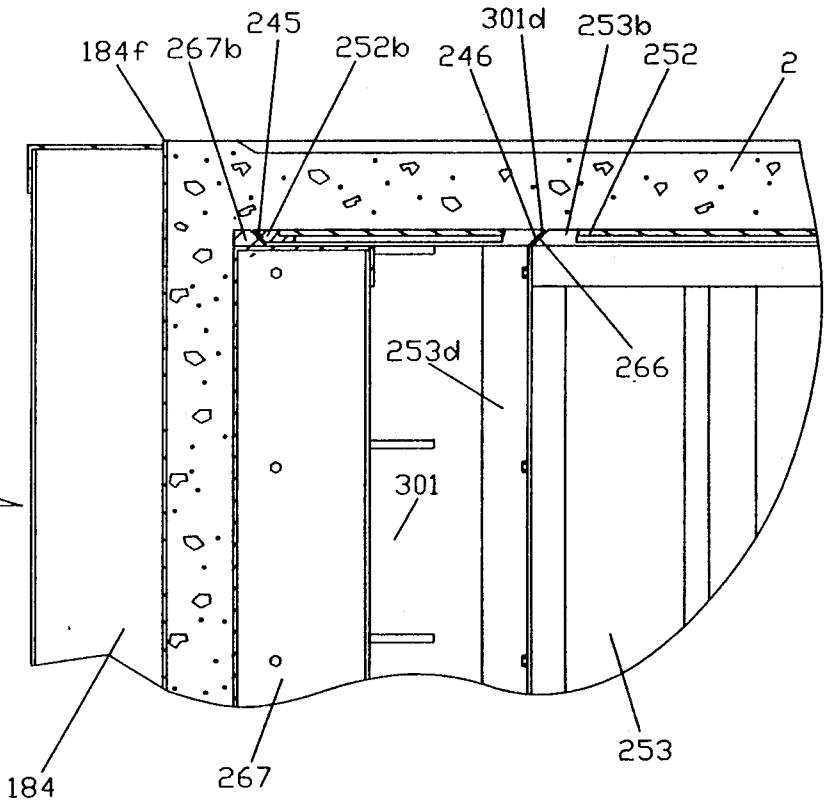
FIG. 23 is an internal, partial, fragmentary cross-sectional view taken along line 23—23 of FIG. 12 and shows the co-action between an exterior wall forming panel and the interior wall forming panels, together with the corner forming panel and the floor forming panel when all are in the casting position.
Figure 24:
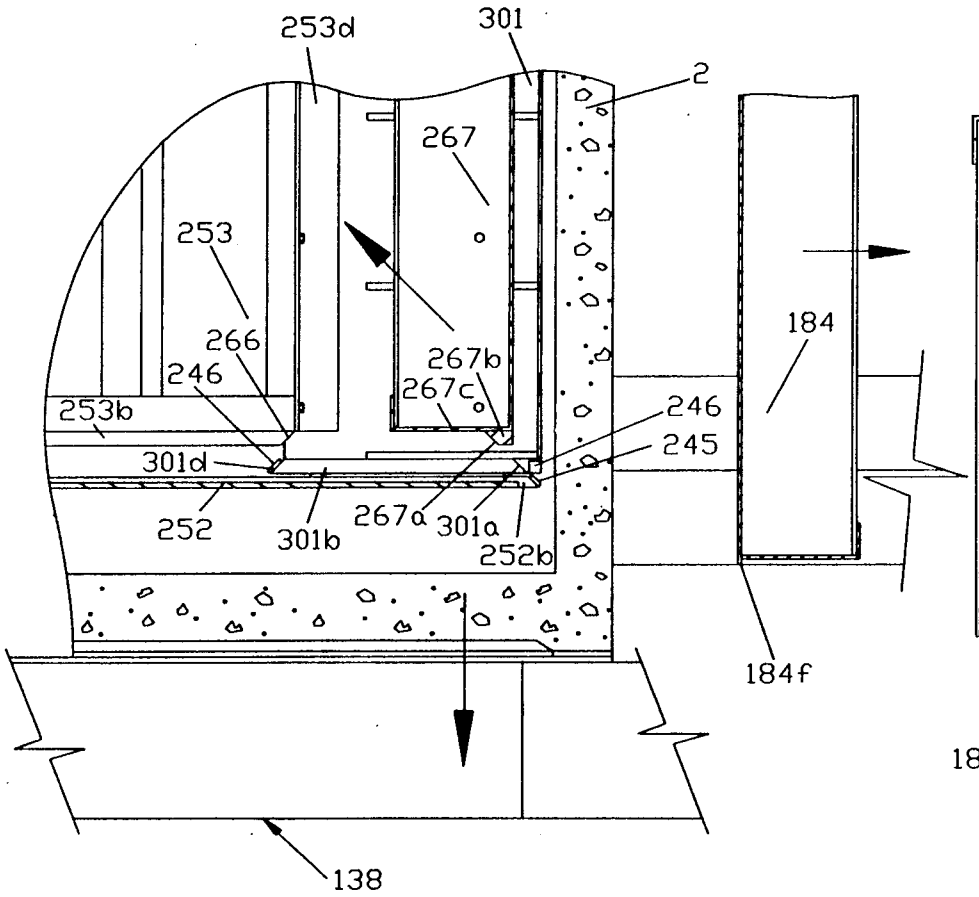
FIG. 24 is similiar to FIG. 23, except that FIG. 24 shows an internal, partial, fragmentary, cross-sectional view which depicts the mold in the load/unload position and the mold is in the release mode.
Figure 26:
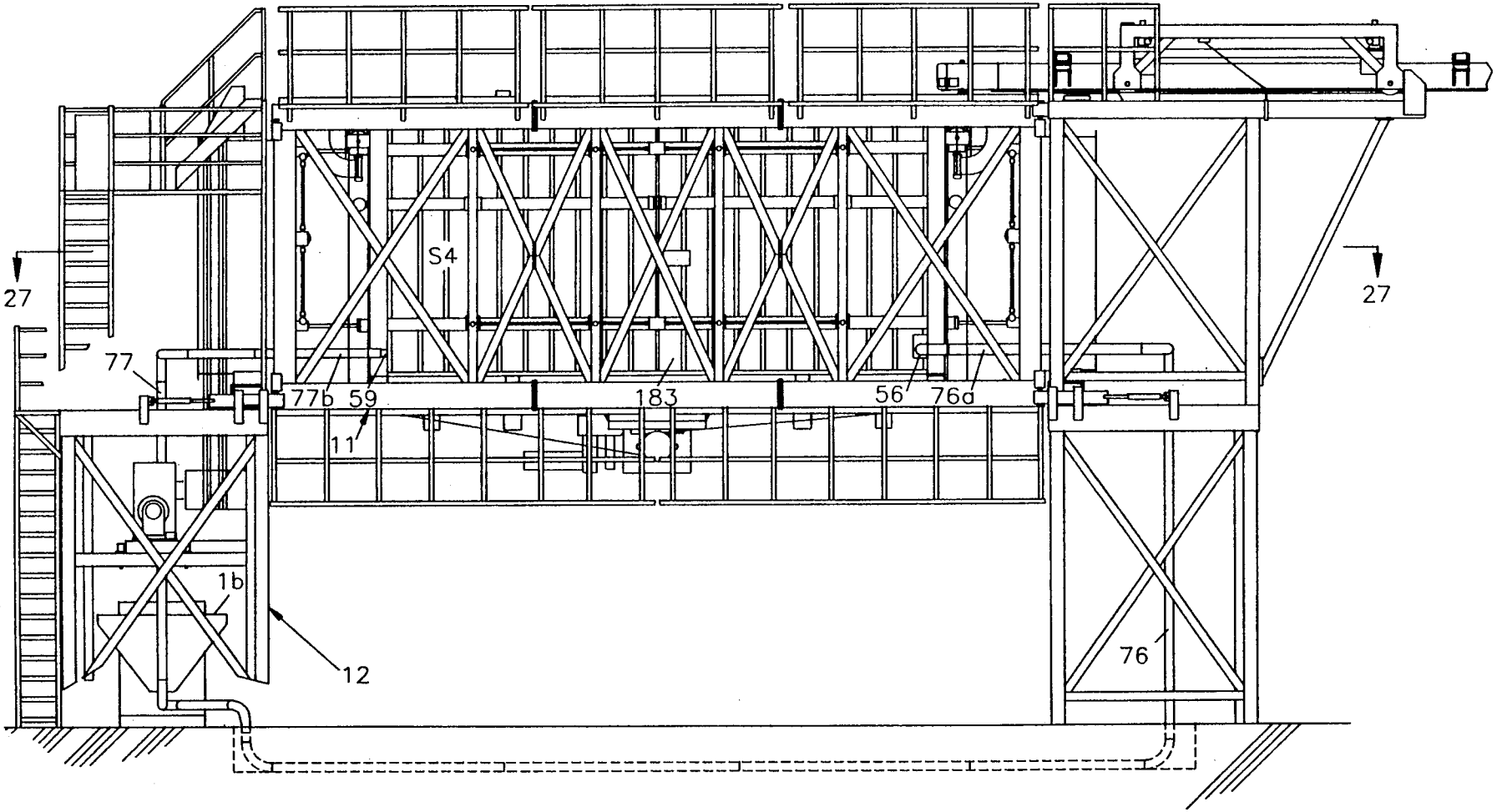
FIG. 26 shows the molding machine connected to a pump for pumping material to be casted into a product in the mold.

Referring to FIGS. 23 and 24 of the drawing show another view of a casted product 2 in the casting position and in a load/unload position, respectively. Referring first to FIG. 23, there is depicted a cross-sectional, internal view of the casted product 2 with the exterior wall forming panel 184, the interior wall forming panels 253 and 267 and the corner forming panel 301, all arranged in a casting position. The angle bracket 253*d* is fastened to the interior wall forming panel 253 and presses against the corner forming panel 301, when in the casting position.

Referring to FIG. 24 of the drawing, the rotatable apparatus 11 of FIG. 23 is rotated 180 degrees to the load/unload position, where the product 2 is fully released from the mold 180 of the molding machine 10 onto the transporter 138. The exterior wall forming panel 184 releases the casted product 2 by moving away from the casted product 2. The interior wall forming panels 253 and 267 both move angularly away from the inner core floor forming panel 252 and the configuration form 181, while the interior wall forming panels 253 and 267 maintain a parallel relationship with the configuration form 181. The angle bracket 253*d* of the interior wall forming panel 253 releases the corner forming panel 301 so that the corner forming panel 301 may also release the product 2 by moving angularly away from the floor forming panel 252 while maintaining a parallel relationship with the configuration form 181. It may now be seen that the outboard edge 266 of the wear shoe 253*b* has released the corner forming panel 301 at the bevelled edge 301*d*, as shown in FIG. 24. Also, the bevelled edge 301*a* of the wear shoe 301*b* has released the synthetic material seal 245 and the bevelled edge 252*a* which is part of the inner core floor forming panel insert 252*b*. Once the product 2 has been released to the transporter 138, the transporter 138 is lowered to the floor 16 and is de-coupled from the hoisting system 110.

Figure 27D:
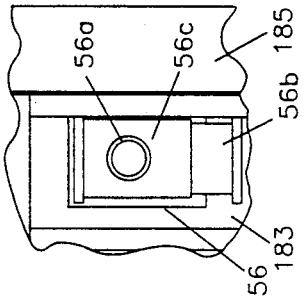
FIG. 27*c* and 27*d* show the working operation of a gate valve in the closed position.
Figure 27C:
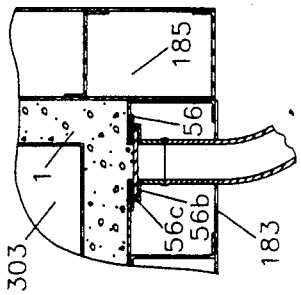
Figure 27B:
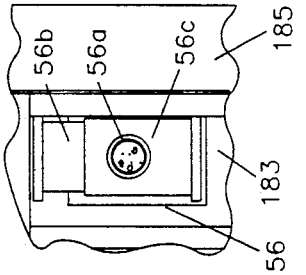
FIG. 27*a* and 27*b* show the working operation of a gate valve in the open position.
Figure 27A:
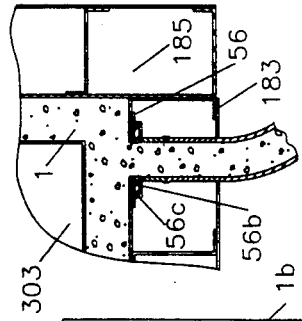
Figure 27:
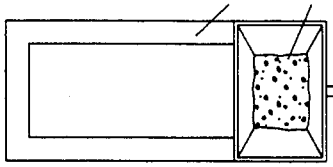
FIG. 27 shows a cross-sectional view of the molding machine connected to the pump for pumping material into the mold.
Figure 27:
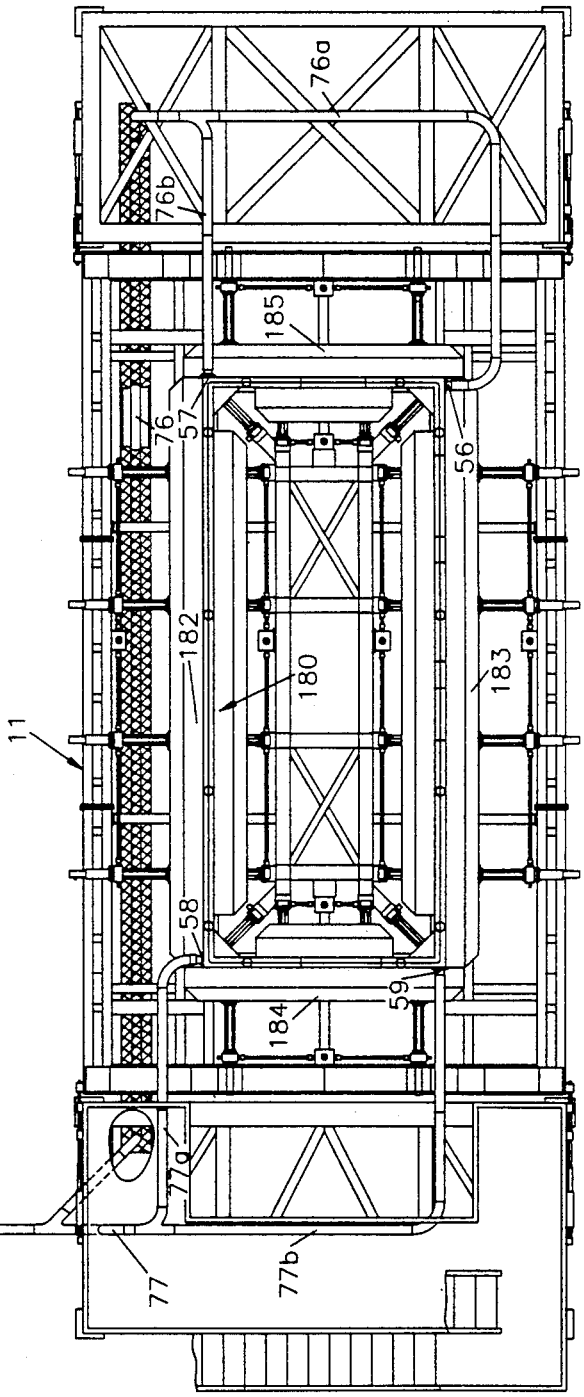

Referring to FIGS. 6, 26, 27, 27*a*, 27*b*, 27*c* and 27*d*, there are shown ways in which the casting material 1 may be fed into the opening 133*a* of the molding machine 10 and into the mold 180, or may be fed through gate valves 56, 57, 58 and 59 to the exterior wall forming panels 183, 185, 182 and 184 respectively. Referring to FIGS. 26, 27, 27*a*, 27*b*, 27*c* and 27*d*, the casting material 1 may be pumped above the ring-shaped casting floor 179 of the configuration form 181 and then upwards, while the rotatable apparatus 11 is in the casting position. The pump 1*b* is connected to the pipe 76 and pipe sections 76*a* and 76*b* which are connected to the gate valves 56 and 57, respectively, that are connected to the mold 180. The pump 1*b* is also connected to the pipe 77 and pipe sections 77*a* and 77*b* which are connected to the gate valves 58 and 59, respectively, that are connected to the mold 180. The pipe sections 76*a*, 76*b*, and 77*a*, 77*b*, must be disconnected from the gate valves 56, 57, 58 and 59, before the rotatable apparatus 11 is rotated. When the mold 180 is filled with the casting material 1, the pump 1*b* is stopped and the gate valves 56, 57, 58 and 59, respectively, are closed. The pipe sections 76*a* and 76*b* are removed from the gate valves 56 and 57. The pipe sections 77*a* and 77*b* are removed from the gate valves 58 and 59. The pipe 76, and pipe sections 76*a*, 76*b*, and the pipe 77, and pipe sections 77*a*, 78*b*, are immediately cleaned by the insertion of plastic, foam or sponge rubber balls, not shown, thereinto, and the plastic, foam or sponge rubber balls, not shown, are blown through by means of pressurized air or water. Other means of cleaning the pipe 76, and pipe sections 76*a*, 76*b*, and the pipe 77, and pipe sections 77*a*, 77*b*, may be cleaned by other solvents. Referring to FIGS. 27*a*, 27*b*, 27*c* and 27*d* of the drawing, the gate valve 56 is similiar to the other gate valves 57, 58 and 59. The gate valve 56 includes a mechanical slide 56*b* which slides in a T-slot 56*c* and cooperates with an opening 56*a* that may either be in the open position as shown in FIGS. 27*a* and 27*b* or may be in the closed position as shown in FIGS. 27*c* and 27*d* of the drawing.

Referring to FIGS. 5 and 6 of the drawing, there is shown a pump 1*b* connected to pipe 77 which is connected to a horizontal boom placer 240 which pivots at pivot joint 241 and is counter-balanced by a counterbalancing weight 242. The horizontal boom placer 240 has another pivot joint 243 which permits the horizontal boom placer 240 to swing over the mold 180 to any point in the opening 133*a*. The horizontal boom placer 240 includes a grip 244 for workers to place the material 1 into the mold 180. The horizontal boom placer 240 is mounted on a tower 248. External vibrators 25 vibrate during the pouring of material 1 into the mold 180 so as to fill the space between the ring-shaped casting floor 179 of the configuration form 181 and the inner core floor forming panel 252 and upwards to the screeding edges 182*f*, 183*f*, 184*f* and 185*f*. The material 1 is screeded at the screeding edges 182*f*, 183*f*, 184*f* and 185*f*.

An alternate way of bringing the casting material 1 to the mold 180 is by the chute 1*a*. The material 1 is placed into the opening 133*a* of the molding machine 10 and is vibrated by the vibrators 25 so that the material 1 flows downward into the mold 180 and upward to the screeding edges 182*f*, 183*f*, 184*f* and 185*f*. The material 1 is thereby casted into the product 2.

Figure 12A:
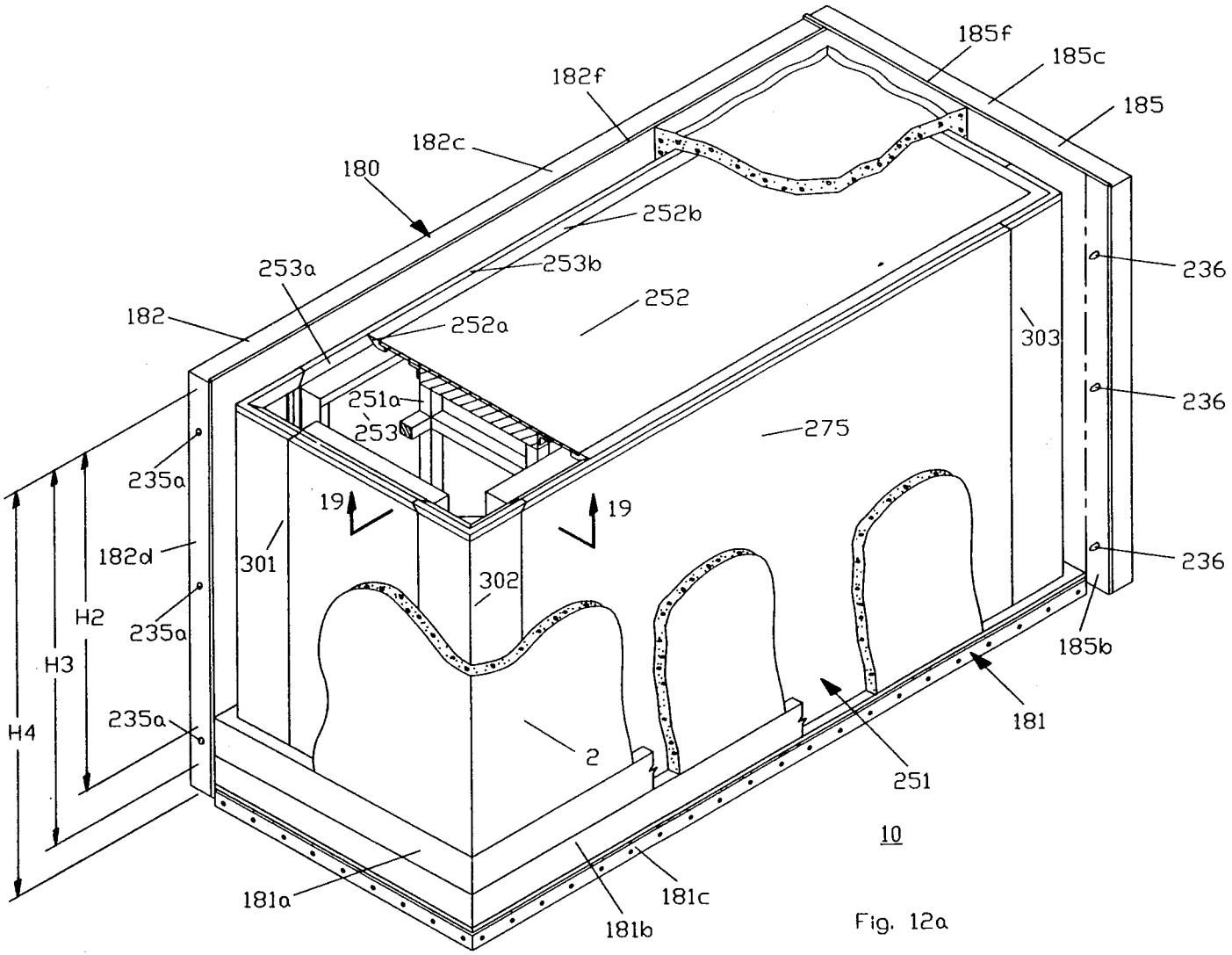
FIG. 12*a* is similiar to FIG. 12, except that different wall heights are casted by the mold.
Figure 25:
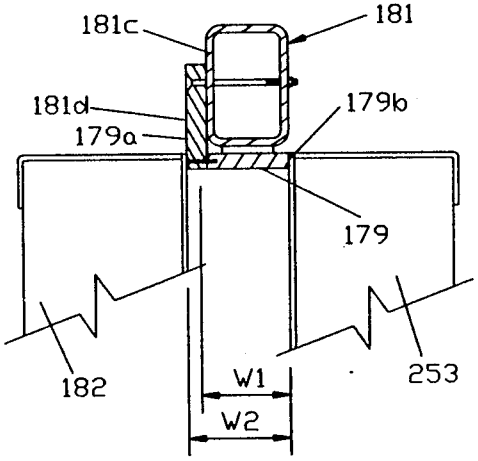
FIG. 25 is a cross-sectional view showing ways in which the configuration form may be changed to give different width thicknesses for the casted product.

Referring to FIGS. 1, 1*a*, 1*b*, 6, 7, 8 and 9 of the drawing, there is shown the four tubular bars 72, 74, 91 and 93, which are water-tight and may be filled with a fluid 70. The fluid 70 acts as a counter-weight to the rotatable apparatus 11. The tubular bars 72, 74, 91 and 93 are parallel to the horizontal axis of rotation 13 of the rotatable apparatus 11, and spaced therefrom. The fluid 70 may be used to balance and stabilize the rotatable apparatus 11 and the product 2 that is casted therein. The product 2 which is cast in the mold 180 may vary in size, weight and distribution of weight. As was mentioned previously herein, the product 2 may have varying heights H2 or H3, or any other heights so desired, as shown in FIGS. 10 and 12*a* of the drawing. The product 2 may have varying wall thicknesses W1 or W2, or such other wall thicknesses, as shown in FIGS. 3*a* and 25 of the drawing. The product 2 may have various openings in which bulkheads 2*c* or 2*d*, or such others, are placed in the reinforcing cage 3 prior to casting the product 2, as shown in FIGS. 2, 6, 10 and 11 of the drawing. The interplay of all of the above cause an unbalanced condition in the mold 180. The unbalanced condition in the mold 180 is offset by placing ballast or fluid 70 in the four horizontal tubular bars 72, 74, 91 and 93. The ballast or fluid 70 is admitted into horizontal tubular bar 72 at valves 72*a* and 72*b*, and into horizontal tubular bar 74 at valves 74*a* and 74*b*, and into horizontal tubular bar 91 at valves 91*a* and 91*b*, and into horizontal tubular bar 93 at valves 93*a* and 93*b*. The ballast or fluid 70 may be added or withdrawm, so as to provide the proper balance for the mold 180 and the rotatable apparatus 11.

The preferred embodiment of the present invention can mold or cast products of varying heights H2, or H3 or H4, or such others, and varying wall thicknesses W1 or W2 or such others. Also, various openings in which bulkheads 2*c* or 2*d* or such others, and component block-outs, such as 2*e*, are all placed in the re-inforcing cage 3. The bulkheads 2*c* and 2*d* stand for windows, doors, portals and other openings. Component block-outs, such as 2*e*, stand for electrical, plumbing or other components casted in the casted product 2. By placing the bulkheads 2*c* or 2*d*, or such others, and component block-outs such as 2*e* in the re-inforcing cage 3 prior to being placed in the mold 180, various products 2 can be obtained without changing the mold 180. For example, it should be noted that the thicknesses of bulkheads 2*c* and 2*d*, and such other bulkheads, are all equal to the wall thicknesses W1, W2 or such other wall thickness, of the product 2 and, therefore, the bulkheads 2*c* and 2*d*, and such others, can be molded in the mold 180 with the application of material 1. It can be seen that when casting the product 2, the material 1 is vibrated to flow around the bulkheads 2*c* and 2*d*, and such other bulkheads and component block-outs such as 2*e*, and such other block-outs, and the re-inforcing cage 3. It can now be seen that no tooling is required in the mold 180 for bulkheads 2*c*, 2*d* and such others, and for the component block-outs 2*e* and such others. Any changes to be made to the product 2 to be casted, except for product heights and thicknesses, is done outside of the mold 180 and in the re-inforcing cage 3.

OPERATION OF THE PREFERRED EMBODIMENT OF THE PRESENT INVENTION

In the operation of the preferred embodiment of the present invention the molding machine 10 is first placed in the load/unload position as may be seen in FIGS. 1, 1*a*, 1*b* and FIG. 2. In the load/unload position, the molding machine 10 receives a transporter 138 with a reinforcing cage 3 directly beneath the opening 133*a* in the sixth side S6 of the rotatable apparatus 11. The hoisting system 110 is coupled to the transporter 138 at four I-bolts 171, 172, 173 and 174, respectively, of the transporter 138. The hoisting system 110 lifts the transporter 138 with the reinforcing cage 3 to the opening 133*a* and into the open mold 180 in the rotatable apparatus 10.

The corner forming panels 300, 301, 302 and 303 angularly move against the inside walls 179*b* of the ring-shaped casting floor 179 of the configuration form 181 and the floor forming panel 252. The corner forming panels 300, 301, 302 and 303 also move simultaneously and parallel to the inside walls 179*b* of the ring-shaped casting floor 179 of the configuration form 181. In response to a signal from the control console 9, the MSA's 305 and 305*a*, 312 and 312*a*, 316 and 316*a*, 321 and 321*a*, respectively move the corner forming panels 300, 301, 302 and 303. Then the corner forming panels 300, 301, 302 and 303 meet the inside walls 179*b* of the ring-shaped casting floor 179 and the floor forming panel 252. The bevelled edge 252*a* and synthetic material seal 245 of the floor forming panel insert 252*b* meet the bevelled edges 300*a*, 301*a*, 302*a* and 303*a* of the wear shoes 300*b*, 301*b*, 302*b* and 303*b*.

The interior wall forming panels 253, 267, 275 and 285 also move at an angle with respect to inside walls 179*b* of the ring-shaped casting floor 179 of the configuration form 181 and the floor forming panel 252, while moving simultaneously and parallel to the ring-shaped casting floor 179 of the configuration form 181. Referring to FIGS., 3 and 3*a* of the drawing, in response to a signal from the control console 9, the MSA's 258 and 258*a*, 259 and 259*a*, 260 and 260, 261 and 261*a*, move the interior wall forming panel 253. In response to a signal from the control console 9, the MSA's 272 and 272*a*, 273 and 273*a*, move the interior wall forming panel 267. In response to a signal from the control console 9, the MSA's 280 and 280*a*, 281 and 281*a*, 282 and 282*a*, 283 and 283*a*, move the interior wall forming panel 275. In response to a signal from the control console 9, the MSA's 288 and 288*a*, 289 and 289*a*, move the interior wall forming panel 285. The interior wall forming panel 253 includes angle brackets 253*d* and 253*e*; the interior wall forming panel 267 includes angle brackets 267*d* and 267*e*; the interior wall forming panel 275 includes angle brackets 275*d* and 275*e*; and the interior wall forming panel 285 includes angle brackets 285*d* and 285*e* and all of the foregoing angle brackets meet the corner forming panels 300, 301, 302 and 303. The outboard edges 300*c* and 300*d* of the corner forming panel 300 meet with the outboard edge 266*a* of interior wall forming panel 253 and the outboard edge 290 of the interior wall forming panel 285, respectively. The outboard edges 301*d* and 301*c* meet with the outboard edge 266 of the interior wall forming panel 253 and the outboard edge 274*a* of the interior wall forming panel 267, respectively. The outboard edges 302*c* and 302*d* meet with the outboard edge 274 of the interior wall forming panel 267 and the outboard edge 284 of the interior wall forming panel 275, respectively. The outboard edges 303*c* and 303*d* meet with the outboard edge 284*a* of the interior wall forming panel 275 and the outboard edge 290*a* of the interior wall forming panel 285, respectively, to thereby close or open the inner core assembly.

The exterior wall forming panels 182, 183, 184 and 185 move parallel and against the outside wall 179*a* of the ring-shaped casting floor 179 of the configuration form 181. In response to a signal from the control console 9, the MSA's 194 and 194*a*, 195 and 195*a*, 196 and 196*a*, 197 and 197*a*, move the exterior wall forming panel 182. In response to a signal from the control console 9, the MSA's 223 and 223*a*, 225 and 225*a*, move the exterior wall forming panel 184. In response to a signal from the control console 9, the MSA's 211 and 211*a*, 212 and 212*a*, 213 and 213*a*, 214 and 214*a*, move the exterior wall forming panel 183. In response to a signal from the control console 9, the MSA's 231 and 231*a*, 233 and 233*a*, move the exterior wall forming panel 185. It should be noted that the exterior wall forming panels 182 and 183 are placed in the casting mode, then the exterior wall forming panels 184 and 185 are then closed and inter-locked with the exterior wall forming panels 182 and 183 by pins 235 and bushings 235*a* and pins 236 and bushings 236*a*. The mold 180 is now closed by moving the exterior wall forming panels 182, 183, 184 and 185 against the outside wall 179*a* of the ring-shaped casting floor 179 of the configuration form 181.

The transporter 138 is located by locators 139, 140, 141 and 142 in the sixth side S6 of the rotatable apparatus. The transporter 138 is locked to the exterior wall forming panels 182 and 183, respectively, by the transporter connectors 36 and 36*a*, and by the insertion of transporter pins 38 which lock the transporter connectors 36 and 36*a* to the transporter blocks 37.

Figure 4:
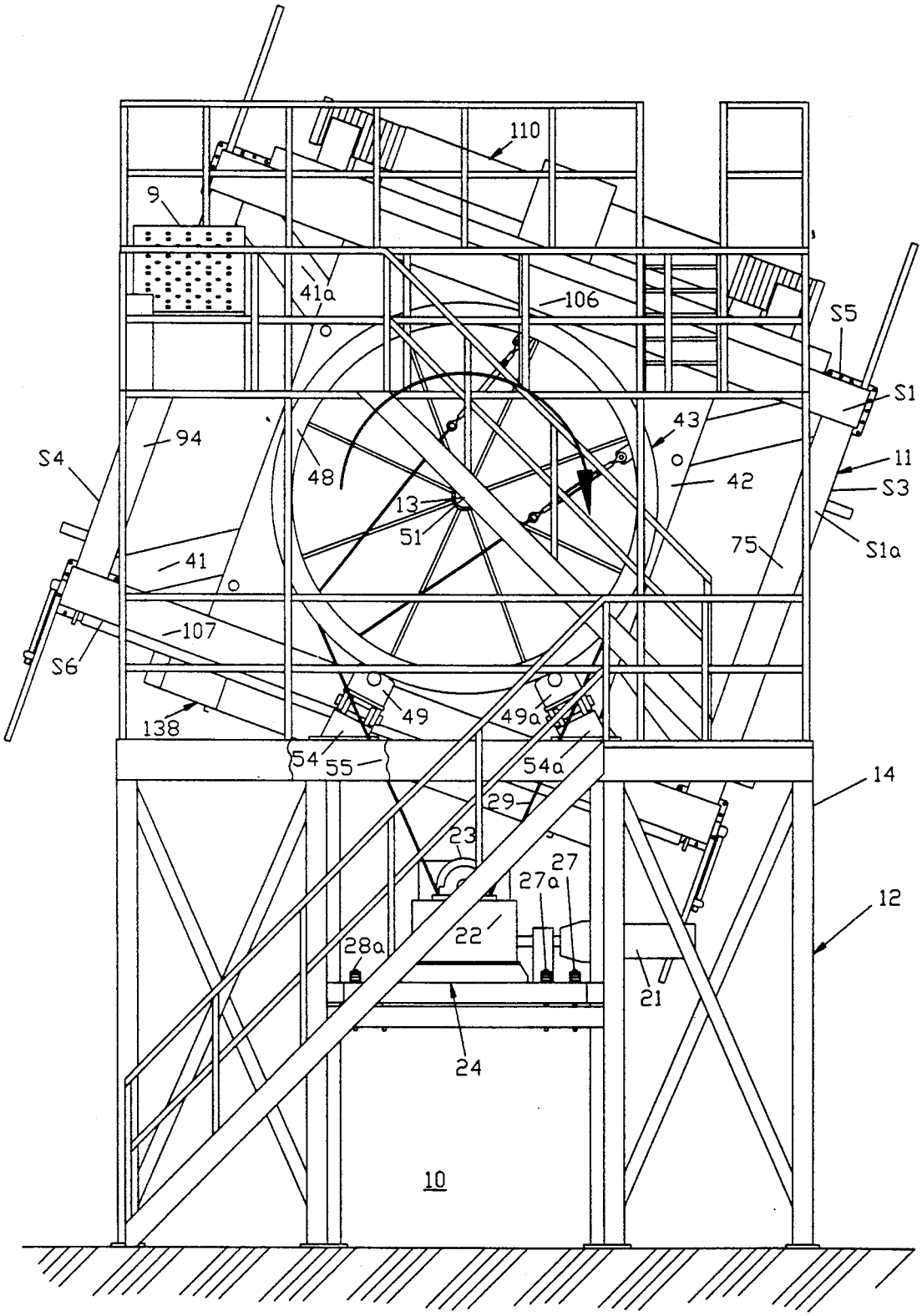
FIG. 4 is a left end-view of the molding machine with the rotatable apparatus being rotated in a clockwise direction into a casting position while the hoisting system locks the transporter to the rotatable apparatus.

The rotatable apparatus 11 then rotates 180 degrees to the casting position, as shown in FIG. 4, at which time the transporter 138 is de-coupled from the hoisting system 110 and the blocks 121, 124, 127 and 129 are held by the retention devices 167, 168, 169 and 170. The transporter connectors 36 and 36*a* are disengaged from the blocks 37 by removing the transporter pins 38 from the holes 39. When the rotatable apparatus 11 is in the casting position, the truck 148 is wheeled from the parked position on the second frame 15 to the transporter 138. The transporter 138 is lifted by the truck 148 by engaging the hangers 155, 156, 157 and 158 of the truck 148, with the holders 151, 152, 153 and 154 of the transporter 138. The MSA's 159, 159*a*, 160 and 160*a* lift the transporter from the sixth side S6 of the rotatable apparatus 11 to the parked position for both the truck 148 and the transporter 138.

The mold 180 is now ready to receive the material 1 to be casted into a product 2, by either pouring the material 1 into the opening 133*a* or by pumping the material 1 by the pump 1*b* to the gate valves 56 and 57 by way of pipes 76 and to the gate valves 58 and 59 by way of pipes 77. Referring to FIGS. 27*a*, 27*b*, 27*c* and 27*d* of the drawing, the gate valve 56 is shown in the open position in FIGS. 27*a* and 27*b*, and is shown in the closed position in FIGS. 27*c* and 27*d*. The gate valves 56, 57, 58 and 59 are similiar to each other. The casted product 2 in the mold 180 is partially cured for approximately two to four hours, after which time the truck 148 moves over the opening 133*a* and the transporter 138 is secured within the four locators 139, 140, 141 and 142. The transporter connectors 36 and 36*a* and transporter blocks 37 are again coupled together by insertion of the pins 38 through holes 39. The transporter 138 is now again coupled to the hoisting system by the insertion of pins 175, 176, 177 and 178 through I-bolts 171, 172, 173 and 174. The rotatable apparatus 11 can now be rotated 180 degrees to the load/unload position.

The rotatable apparatus 11 is now rotated 180 degrees to the load/unload position at which point the transporter connectors 36 and 36*a* are de-coupled by the removal of the pins 38 through holes 39. The exterior wall forming panels 182, 183, 184 and 185 are moved away from the outside walls 179*a* of the ring-shaped casting floor 179 of the configuration form 181. The interior wall forming panels 253, 267, 275 and 285 are angularly moved from the configuration form 181 and inner core floor forming panel 252 and moved parallel to the inside walls 179*b* of the ring-shaped casting floor 179 of the configuration form 181. In a similiar manner the corner forming panels 300, 301, 302 and 303 move angularly from the inside walls 179*b* of the ring-shaped casting floor 179 of the configuration form 181 and parallel to the inside walls 179*b* of the ring-shaped casting floor 179 of the configuration form 181 while the transporter 138 and hoisting system 110 supports the casted product 2. The casted product 2 is supported on a rubber pad spacer 7 on the transporter 138, as shown in FIG. 13 of the drawing. The casted product 2 is released from the mold 180. The transporter 138 is lowered by the hoisting system 110 to the floor 16, at which point the pins 171, 172, 173 and 174 are pulled from the I-bolts 171, 172, 173 and 174. The transporter 138 is now de-coupled from the hoisting system 110 and can be wheeled away on casters 150, as shown in FIGS. 10 and 11 of the drawing.

Figure 28:
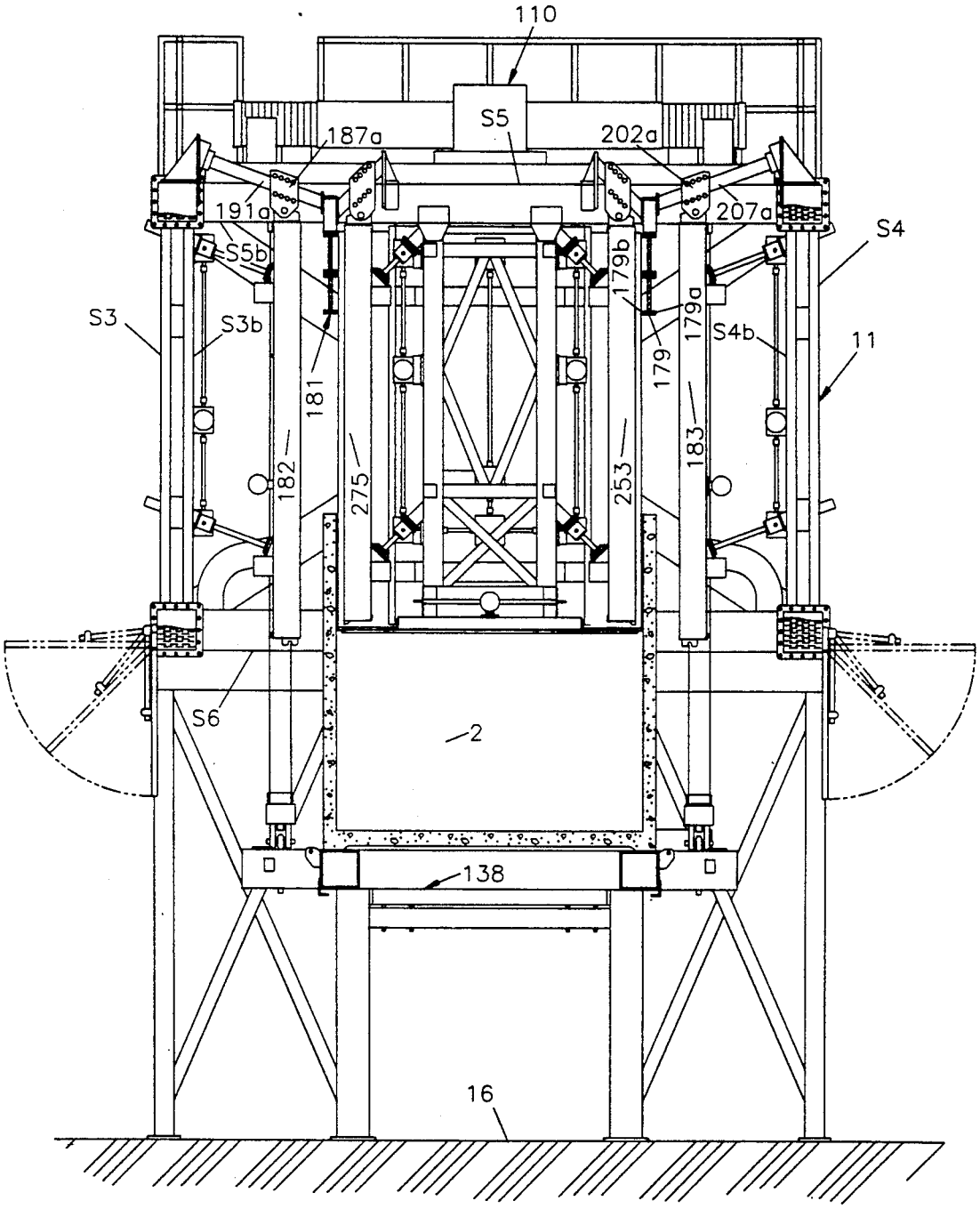
FIG. 28 is a cross-sectional view like FIG. 9, except that the exterior wall forming panels move at an angle with respect to the configuration form and the floor panel and parallel to the configuration form.

Having thus described the invention it will be evident that other modifications and improvements may be made by one skilled in the art which would come within the scope of the annexed claims, for example in FIG. 28 of the drawing, the exterior wall forming panels 182 and 183 may have an angular movement as do interior forming panels 275 and 253 by placing shafts 197*a* and 207*a*, respectively, at an angle with respect to the outside wall 179*a* of the ring-shaped casting floor 179 of the configuration form 181. The sleeve bearings 187*a* and 202*a* would also have to be modified to ride on shafts 197*a* and 207*a*.

What is claimed is:

1. A molding machine for casting a product comprising:

A. a stationary support system having a first and second spaced apart frames;

B. a rotatable apparatus having a horizontal axis of rotation for rotating on said first and second spaced apart frames and having an opening in a side of said rotatable apparatus parallel to said horizontal axis of rotation;

C. a transporter for carrying said product;

D. locating means on said rotatable apparatus for locating said transporter over said opening of said side of said rotatable apparatus for rotation therewith;

E. a hoisting means fixed to the exterior surface of another side of said rotatable apparatus and coupled to said transporter for raising or lowering said transporter to said opening of said rotatable apparatus and for securing said transporter when rotating said rotatable apparatus with said transporter to said casting position or to a load and unload position;

F. locking means cooperating with said stationary support system and said rotatable apparatus for selectively locking said rotatable apparatus with said opening downward in said load and unload position and after rotating said rotatable apparatus 180 degrees so that said opening faces upward in said casting position;

G. a truck with a jacking mechanism means for lifting and lowering said transporter from said opening in said side of said rotatable apparatus, when said rotatable apparatus is in said casting position;

H. molding means including:

(i) a configuration form having a stationary ring-shaped casting floor mounted to an interior surface of said rotatable apparatus and diametrically opposite to said opening in said rotatable apparatus;

(ii) moveable exterior wall forming panels disposed within said rotatable apparatus and cooperating with said ring-shaped casting floor to enclose said mold;

(iii) first positioning means disposed within said rotatable apparatus for moving said exterior wall forming panels toward and away from said ring-shaped casting floor when said rotatable apparatus is in the load and unload position;

(iv) an inner core means having a stationary floor forming panel spaced from said stationary ring-shaped casting floor, and concentric within said ring-shaped casting floor and including:

(iv)(a) moveable corner forming panels disposed within said ring-shaped casting floor so as to cooperate with said ring-shaped casting floor and said floor forming panel;

(iv)(b) second positioning means for moving, at an angle, said moveable corner forming panels toward and away from said ring-shaped casting floor, and said stationary floor forming panel, when said rotatable apparatus is in the load and unload position;

(iv)(c) moveable interior wall forming panels disposed within said ring-shaped casting floor and cooperating with said ring-shaped casting floor and said stationary floor forming panel, and said moveable corner forming panels, when said rotatable apparatus is in said load and unload position to enclose said inner core means, and (iv)(d) third positioning means for moving, at an angle, said moveable interior wall forming panels toward and away from said ring-shaped casting floor, said stationary floor forming panel, and said moveable corner forming panels, when said rotatable apparatus is in said load and unload position and said hoisting means and said transporter support said product.

2. A molding machine for casting a product comprising:

A. a stationary support system having a first frame and a second frame spaced apart from each other;

B. a rotatable apparatus mounted for rotation along a horizontal axis of rotation for rotating on said first and second frames and including:

(i) an opening in a side of said rotatable apparatus parallel to said horizontal axis of rotation, C. a rotational means fixed to said support system and connected to said rotatable apparatus for rotating said rotatable apparatus, and being moved thereby so that said opening in said side of said rotatable apparatus faces downward in a load and unload position, and for rotating said rotatable apparatus 180 degrees, so that said opening in said side of said rotatable apparatus faces upwards in a casting position;

D. a locking means, cooperating with said support system and said rotatable apparatus, for selectively locking said rotatable apparatus in said load and unload position, and for selectively locking said rotatable apparatus in said casting position;

E. a transporter carrying said product;

F. a hoisting means fixed to an exterior surface of another side of said rotatable apparatus that is diametrically opposite to said opening in said side of said rotatable apparatus, for raising said transporter to said opening of said side of said rotatable apparatus, or for lowering said transporter with said product, when said rotatable apparatus is in said load and unload position, while rotating by said rotational means, said rotatable apparatus, with said transporter, to said casting position or to said load and unload position;

G. a truck with jacking mechanism means for lifting and for moving said transporter from said opening in said side of said rotatable apparatus, when said rotatable apparatus is in said casting position; and H. a mold including:

(i) a configuration form fixed to an interior surface of said another side of said rotatable apparatus and being diametrically opposite to said opening in said side of said rotatable apparatus;

(ii) said configuration form being an encircling arrangement with a ring-shaped casting floor of a given width between outside walls and inside walls of said configuration form;

(iii) an exterior wall forming panel means cooperating with said outside walls of said configuration form, and being disposed within said rotatable apparatus, for defining exterior walls of said product, when said exterior wall forming panels are in a casting mode;

(iv) said exterior wall forming panel means being moveable toward or away from said outside walls of said configuration form, and said rotatable apparatus, in said load and unload position of said rotatable apparatus, with said transporter being held to said side, with said opening, of said rotatable apparatus by said hoisting means;

(v) an inner core means for casting interior walls and a floor of said product in said casting position and for releasing said product in said load and unload position and including:

(v)(a) an inner core frame disposed within said configuration form and fixed to said interior surface of said another side of said rotatable apparatus;

(v)(b) an floor forming panel for casting thereon, and fixed to said inner core frame and spaced from said configuration form;

(v)(c) a moveable corner forming panel means being in cooperative relationship with said configuration form and said floor forming panel for casting said product when said rotatable apparatus is in the casting position;

(v)(d) said corner forming panel means being moveable at an acute angle with respect to said floor forming panel and said configuration form when said rotatable apparatus is in said load and unload position;

(v)(e) an interior wall forming panel means in cooperative relationship with said configuration form, said floor forming panel and said corner forming panel means, for casting said product when said rotatable apparatus is in said casting position; and (v)(f) said interior wall forming panel means being moveable at said angle with respect to said floor forming panel and said configuration form and parallel to said inside wall of said configuration form, when said rotatable apparatus is in said load and unload position, and said transporter being held to said side, with said opening, of said rotatable apparatus, by said hoisting means.

3. A molding machine for casting a product comprising:

A. a stationary support system having a first frame and a second frame spaced apart from each other;

B. a rotatable apparatus mounted for rotation along a horizontal axis of rotation for rotating on said first and second frames and including:

(i) an opening in a side of said rotatable apparatus parallel to said horizontal axis of rotation, (ii) a moveable transporter for carrying said product;

(iii) locating means for locating said transporter over said opening of said side of said rotatable apparatus;

C. a rotational means fixed to said support system and connected to said rotatable apparatus for rotating said rotatable apparatus, so that said opening in said side of said rotatable apparatus faces downward in a load and unload position, and for rotating said rotatable apparatus upwards 180 degrees, so that said opening in said side of said rotatable apparatus faces upwards in a casting position;

D. a locking means, cooperating with said support system and said rotatable apparatus, for selectively locking said rotatable apparatus in said load and unload position, and for selectively locking said rotatable apparatus in said casting position;

E. a hoisting means fixed to an exterior surface of another side of said rotatable apparatus that is diametrically opposite to said opening in said side of said rotatable apparatus, for raising or lowering said transporter to said locating means and said opening of said rotatable apparatus, when said rotatable apparatus is in said load and unload position, and for securing said transporter to said rotatable apparatus and for rotating, by said rotational means, said rotatable apparatus, while with said transporter to said casting position or to said load and unload position;

F. a truck with jacking mechanism means for lifting or for lowering and for moving said transporter from said opening in said side of said rotatable apparatus, to a parked position, over said first frame or said second frame of said stationary support system, when said rotatable apparatus is in said casting position; and G. a mold including:

(i) a configuration form fixed to an interior surface of said another side of said rotatable apparatus and being diametrically opposite to said opening in said side of said rotatable apparatus;

(ii) said configuration form being an encircling arrangement with a ring-shaped casting floor of a given width between outside walls and inside walls of said configuration form;

(iii) an exterior wall forming panel means cooperating with said outside walls of said configuration form, and being disposed within said rotatable apparatus, for defining exterior walls of said product;

(iv) first means for moving said exterior wall forming panel means to or from said outside walls of said configuration form;

(v) an inner core means for casting interior walls and floor of said product in said casting position and for releasing said product in said load and unload position and including:

(v) (a) an inner core frame disposed within said configuration form and fixed to said interior surface of said another side of said rotatable apparatus;

(v) (b) a floor forming panel for casting thereon, and fixed to said inner core frame and spaced from said configuration form;

(v) (c) sealing means set around said floor forming panel, around the full measure of the perimeter of said floor forming panel;

(v) (d) a corner forming panel means being in cooperative relationship with said configuration form and said sealing means and said floor forming panel for casting said product;

(v) (e) said corner forming panel means being moveable at an angle with respect to said floor forming panel and said configuration form and parallel to said inside wall of said configuration form, when said rotatable apparatus is in said load and unload position;

(v) (f) an interior wall forming panel means in cooperative relationship with said configuration form, said sealing means, said core floor forming panel and said corner forming panel means, for casting said product when said rotatable apparatus is in said casting position; and (v) (g) said interior wall forming panel means being moveable at an angle with respect to said floor panel and said configuration form to said when said rotatable apparatus is in said load and unload position, and said transporter being held by said hoisting means, and said transporter being in said locating means of said rotatable apparatus.

4. The invention defined in claims 1 or 2 or 3 wherein said mold includes said inner core means having moveable corner forming panels and moveable interior wall forming panels which inter-lock in said casting position.

5. The invention defined in claims 1 or 2 or 3 wherein said inner core means includes a floor forming panel with a sealing means which cooperates with said corner forming panels and said interior wall forming panel together in the casting mode to receive the material to be cast into a product, but to prevent said material from flowing therethrough.

6. The invention defined in claims 1 or 2 or 3 wherein said rotatable apparatus may be assembled and disassembled in parts for shipment thereof.

7. The invention defined in claims 1 or 2 or 3 wherein said rotatable apparatus includes water tight tubular bars opposite to each other and parallel to said horizontal axis of rotation, and each being partially filled with a fluid, so that by use of said tubular bars the weight of said rotatable apparatus is equally distributed.

8. The invention defined in claims 1 or 2 or 3 wherein said molding machine casts products of different heights by the insertion of configuration forms of different heights.

9. The invention defined in claims 1 or 2 or 3 wherein said molding machine casts products of different wall thicknesses by changing the thickness of said configuration form and by the addition of spacers at opposite ends of said exterior wall forming panels, which are parallel to each other.

10. The invention defined in claims 1 or 2 or 3 wherein said side with said opening in said rotatable apparatus includes locking means for locking said transporter to said side with said opening in said rotatable apparatus, and making said transporter the portable side of said rotatable apparatus.

11. The invention defined in claims 1 or 2 or 3 wherein said mold includes transporter connector means for coupling said transporter to said exterior wall forming panels, which are parallel to each other, so that said transporter rotates with said mold in said rotatable apparatus during rotation of said rotatable apparatus, thereby supporting the product.

12. The invention defined in claims 1 or 2 or 3 wherein said mold includes said exterior wall forming panels which interlock about said configuration form.

13. The invention defined in claims 1 or 2 or 3 wherein said exterior wall forming panels, said moveable interior wall forming panels and said moveable corner forming panels move so that said molding machine casts products that have square corners and draft-free walls.

14. The invention defined in claims 1 or 2 or 3 wherein said molding machine casts products having various bulkheads and component block-outs which are pre-assembled in a reinforcing cage, before being placed in said mold, without requiring the use of another mold.

15. The invention defined in claims 1 or 2 or 3 wherein said molding machine includes means for pumping material into said mold.

16. The invention defined in claims 1 or 2 or 3 wherein said molding machine includes:

(i) gate valves, having an open position and a closed position, and being fixed to said exterior wall forming panels; and (ii) pumping means, connected to said gate valves, for pumping material through said gate valves and into said mold, when gate valves are in said open position and for closing said gate valves when said mold is filled with said material.

17. The invention defined in claims 1 or 2 or 3 wherein said molding machine includes (i) a tower;

(ii) a horizontal boom placer positioned on said tower;

(iii) pumping means for pumping a material; and (iv) piping means connected between said pumping means and said horizontal boom placer for pumping said material to said mold.

18. The invention defined in claims 1 or 2 or 3 wherein said rotatable apparatus includes four water-tight tubular bars disposed mutually parallel to said horizontal axis of rotation and each being capable of holding a fluid to give stability to said rotatable apparatus, said mold and said product.

19. The invention defined in claims 1 or 2 or 3 wherein said mold and said rotatable apparatus and said transporter are locked together by said locking means and by said hoisting means, when said rotatable apparatus is rotated.

20. The invention defined in claims 1 or 2 or 3 wherein said inner core means includes sealing means being fixed around said floor forming panel and cooperating with said moveable corner forming panels and said moveable interior wall forming panels for sealing said moveable corner forming panels and said moveable interior wall forming panels to said floor forming panel, when said mold is in the casting mode or said load and unload position.

* * * * *